US011661803B2

(12) United States Patent
Hauck

(10) Patent No.: US 11,661,803 B2
(45) Date of Patent: May 30, 2023

(54) ROD HANDLING SYSTEM

(71) Applicant: ROD DEPLOYMENT SYSTEMS, LLC, Dickinson, ND (US)

(72) Inventor: Tobias Hauck, Dickinson, ND (US)

(73) Assignee: Rod Deployment Systems, LLC, Dickinson, ND (US)

( * ) Notice: Subject to any disclaimer, the term of this patent is extended or adjusted under 35 U.S.C. 154(b) by 0 days.

(21) Appl. No.: 17/729,332

(22) Filed: Apr. 26, 2022

(65) Prior Publication Data

US 2022/0349267 A1 Nov. 3, 2022

Related U.S. Application Data

(60) Provisional application No. 63/180,740, filed on Apr. 28, 2021.

(51) Int. Cl.
*E21B 19/15* (2006.01)
*E21B 19/14* (2006.01)

(52) U.S. Cl.
CPC ..... *E21B 19/155* (2013.01); *E21B 19/143* (2013.01)

(58) Field of Classification Search
CPC ..... E21B 19/155; E21B 19/14; E21B 19/15; E21B 19/16; E21B 19/20
See application file for complete search history.

(56) References Cited

U.S. PATENT DOCUMENTS 3,212,593 A 10/1965 Reischl
4,445,579 A 5/1984 Bello
4,899,832 A * 2/1990 Bierscheid, Jr. ..... E21B 15/00 173/217
5,174,389 A 12/1992 Hansen
5,375,667 A 12/1994 Trevisani
6,113,334 A 9/2000 Riva
6,202,863 B1 * 3/2001 Grenier ..... B65D 88/123 414/22.62

(Continued)

FOREIGN PATENT DOCUMENTS

GB 2 083 106 B 9/1984

OTHER PUBLICATIONS

International Search Report and Written Opinion for International Application No. PCT/US2022/026439, dated Jul. 1, 2022, 9 total pages.

*Primary Examiner* — Lynn E Schwenning
(74) *Attorney, Agent, or Firm* — Mai D. Lauer; Westman, Champlin & Koehler P.A.

(57) ABSTRACT

A system includes a crate and a deployer. The crate is configured to contain a plurality of elongated rods; the crate has a length, width and height. The deployer includes a bed frame upper surface, a crate support frame, a tilt mechanism and a scope mechanism. The crate support frame includes an attachment mechanism configured for removable attachment of the crate, wherein the crate support frame has a longitudinal extent aligned with the length of an attached crate. The tilt mechanism is configured to move the crate support frame between a horizontal position parallel to the bed frame upper surface and a vertical position normal to the bed frame upper surface. The scope mechanism is configured to move the crate support frame linearly along its longitudinal extent. A method of deploying a plurality of rods to a selected location is also described.

20 Claims, 23 Drawing Sheets

(56) References Cited

U.S. PATENT DOCUMENTS

| | | | | |
|---|---|---|---|---|
| 6,966,106 | B1 * | 11/2005 | Roodenburg | E21B 19/14 29/407.1 |
| 7,922,011 | B2 * | 4/2011 | Knight | E21B 19/14 211/60.1 |
| 7,922,012 | B2 * | 4/2011 | Sisley | H02G 3/0406 248/74.1 |
| 8,083,009 | B2 * | 12/2011 | Comacchio | E21B 19/155 414/22.58 |
| 8,490,718 | B2 | 7/2013 | Lunde | |
| 9,523,249 | B2 | 12/2016 | Binder et al. | |
| 10,138,691 | B2 * | 11/2018 | Kos | E21B 15/00 |
| 10,258,153 | B2 * | 4/2019 | Patton, Jr. | B64F 5/50 |
| 10,584,541 | B2 * | 3/2020 | Reddy | E21B 15/00 |
| 10,927,615 | B2 * | 2/2021 | De Mul | E21B 19/14 |
| 2010/0239404 | A1 | 9/2010 | Blanchard et al. | |
| 2014/0027106 | A1 | 1/2014 | Huseman et al. | |
| 2014/0027395 | A1 * | 1/2014 | Benoit | E21B 19/14 211/70.4 |
| 2015/0166260 | A1 | 6/2015 | Pham et al. | |

* cited by examiner

ROD HANDLING SYSTEM

CROSS REFERENCE TO RELATED APPLICATIONS

This application claims the benefit of priority of U.S. patent application Ser. No. 63/180,740, filed Apr. 28, 2021. The content of this priority application is hereby incorporated by reference in its entirety.

BACKGROUND

Sucker rods are utilized in conjunction with above ground pumping units and attached downhole equipment for the extraction of crude oil from below the earth's surface. Rods are provided in various lengths, are typically made of either steel or fiberglass, and have typical diameters between ⅝-inch (1.6 cm) and 1-⅛ inch (2.9 cm) and a length of about 24 feet (7.3 m). Each rod is equipped with a coupler, allowing two or more rods to be screwed together and extended into the wellbore to the downhole pump. The rods, once connected to each other, are known as a rod string. The rod string is attached to a pumping unit at the earth's surface and to a downhole pump in the wellbore deep below the earth's surface. As the pumping unit is powered, it lowers and raises the rod string and therefore the downhole pump. As the downhole pump is raised and lowered while submersed in liquid crude oil, it pulls the liquid to the earth's surface using a series of check valves that permit the fluid to move upward and prevent it from escaping from the bottom.

Depending on the depth of the liquid zone (producing zone) in which the downhole pump is set, a rod string can be made up of hundreds of individual rods. A workover rig and associated equipment are used above the ground surface in assembly of the rods and lowering them and other downhole equipment down the wellbore. During initial installation, the downhole equipment and individual rods are lowered from above the ground surface into the wellbore in sequence. Conventionally, two members of the workover rig crew carry an individual rod from a transport cribbing to the wellbore. The workover rig, operated by a crew member, lifts one end of the rod so that it hangs vertically. The pump is held at the top of the wellbore, where the bottom end of the rod is threaded to it. The pump and rod are lowered by the workover rig until the top of the rod is at the top of the wellbore. Assembly of the rod string begins, in which a second rod is threaded to the first. The second rod is lowered until the top of the rod is at the top of the wellbore. This process is repeated until the pump is at the desired depth.

Commonly, a tool called a rod tong is operated by a crew member and is used to screw one rod to another. A rod tong holds one rod stationary while rotating the other rod until they are screwed together. Throughout the life of the well, a rod string may have to be removed from the wellbore and re-installed several times due to downhole equipment, piping, or rod failures. Rod failures typically start as surface imperfections on the rod and proceed to larger fractures caused by mechanical stress, the corrosive nature of the downhole environment, and damage incurred while handling the rods, among other factors.

The conventional practices associated with the transport, removal and installation of rods typically result in rod damage, crew member fatigue, and downtime for the well. The carrying of the rods by the crew members from the storage area or transport trailer to the wellbore is known as "tailing." "Tailing out" is when the rods are carried from the wellbore to the storage area or to the transport trailer. Tailing out requires the workover rig to lift a rod from the wellbore. When the rod is lifted, a crew member physically moves the bottom end of the rod out and away from the rig as the operator of the rig simultaneously lowers the top of the rod to the rig floor or ground surface, where the top end of the rod is removed from the rig's lifting equipment and supported by a second crew member. The two crew members now fully support the weight of the removed rod. The crew members carry the rod to a designated area, where it is set down and laid horizontally either on a stand or on the ground surface. There it lies until it is either removed from the location or reassembled into a rod string and lowered back into the wellbore.

The conventional method of tailing rods "out" requires one crew member to support approximately half the rod weight while walking a minimum distance equal to the length of the rod over the ground surface or possibly down steps off the rig floor, in addition to a desired distance away from the rig. It also requires a second crew member to support the weight of the other end of the rod when it is removed from the rig's lifting equipment; the second crew member follows the first crew member to the location where the rod will be laid down.

Tailing rods "in" uses the same processes but in the reverse order. Two crew members carry the rod from the storage area to the wellbore. Once at the wellbore, one crew member affixes the rod to the workover rig's lifting equipment. The rig operator lifts the rod vertically into the air until the bottom of the rod is at the top of the wellbore. The rod is then threaded to the pumping equipment or another rod that has been previously set into the wellbore. Now attached to the equipment or rod(s) below, it is lowered to the top of the wellbore and the process is repeated until the desired depth is reached.

The conventional method of tailing rods in uses two crew members to support the weight of the rod while walking from the storage area over the ground surface and possibly up steps onto the rig floor to the wellbore. A significant amount of stress is induced onto the rod when it is held in a non-vertical position and not properly supported, allowing it to bend or bow. The conventional method of carrying the rods to or from the wellbore results in the unsupported bending or bowing of the rods. Additional fatigue to the rods is common when the rods are not appropriately supported while being stored. Proper storage of the rods is described in API RP 11BR (American Petroleum Institute Recommended Practice). This standard sets guidelines for how the rods should be supported to minimize stress caused by bowing or bending of an unsupported or inadequately supported rod, as well as other methods of preventing damage. Sometimes, proper supporting materials are not available at the working location or guidelines are neglected.

The same API standard applies to how the rods are stored while in transport. When rods are transported in the conventional process, they are individually moved from the ground or rack by hand to a trailer and secured to the trailer in accordance with Federal Motor Carrier Safety Administration (FMCSA) regulations. When the rods are removed from the transport trailer, they are again removed individually. Because each rod is maneuvered individually, this compounds the potential for damage.

Oil well locations are typically constructed of gravel, scoria rock or dirt, resulting in uneven and unstable walking surfaces. Additionally, the hazards of the walking area can be compounded by the well's associated equipment, piping, and the overall housekeeping habits of the rig crew. For a single trip into or out of the wellbore, and in a case in which there are 400 rods for the string, and each rod is about 25 feet (7.6 m) long, the crew member tailing the bottom of the rod would have to walk over a minimum of 3.75 miles (6.0 km) over the uneven ground surface. Moreover, when the rods are moved onto and off a transport trailer by hand, this movement requires that at least one crew member climbs onto the trailer at an elevated height to pick up or set down the rod. In the processes described above, rods are often handled individually, taking a significant amount of time; moreover, conventional practices are highly inefficient when the crew members tail rods or when they are set onto or removed from the transport trailer.

Another inefficiency observed in rod handling occurs when rods are prepared for initial installation (i.e., "prepping"). When rods are purchased, they are typically transported from the manufacturer or distributor to the well location. Rod preparation includes the cleaning of the individual rods of oils and debris created in the manufacturing process, as well as installing couplers on the ends to allow the rods to be connected together. This process is typically completed by the rig crew, taking them away from other essential tasks.

SUMMARY

In one aspect, a system includes a crate and a deployer. The crate is configured to contain a plurality of elongated rods; the crate has a length, width and height. The deployer includes a bed frame upper surface, a crate support frame, a tilt mechanism and a scope mechanism. The crate support frame includes an attachment mechanism configured for removable attachment of the crate, wherein the crate support frame has a longitudinal extent aligned with the length of an attached crate. The tilt mechanism is configured to move the crate support frame between a horizontal position parallel to the bed frame upper surface and a vertical position normal to the bed frame upper surface. The scope mechanism is configured to move the crate support frame linearly along its longitudinal extent.

In another aspect, a method of deploying a plurality of rods to a selected location is described. The method includes attaching a first crate to a deployer, wherein the first crate is disposed in a horizontal position, transporting the deployer to the selected location, actuating the tilt mechanism to raise the first crate from the horizontal position to the vertical position, and actuating the scope mechanism to move the first crate vertically to a desired height above a ground surface.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. All descriptions are applicable to like and analogous structures throughout the several embodiments, unless otherwise specified.

Figure 1:
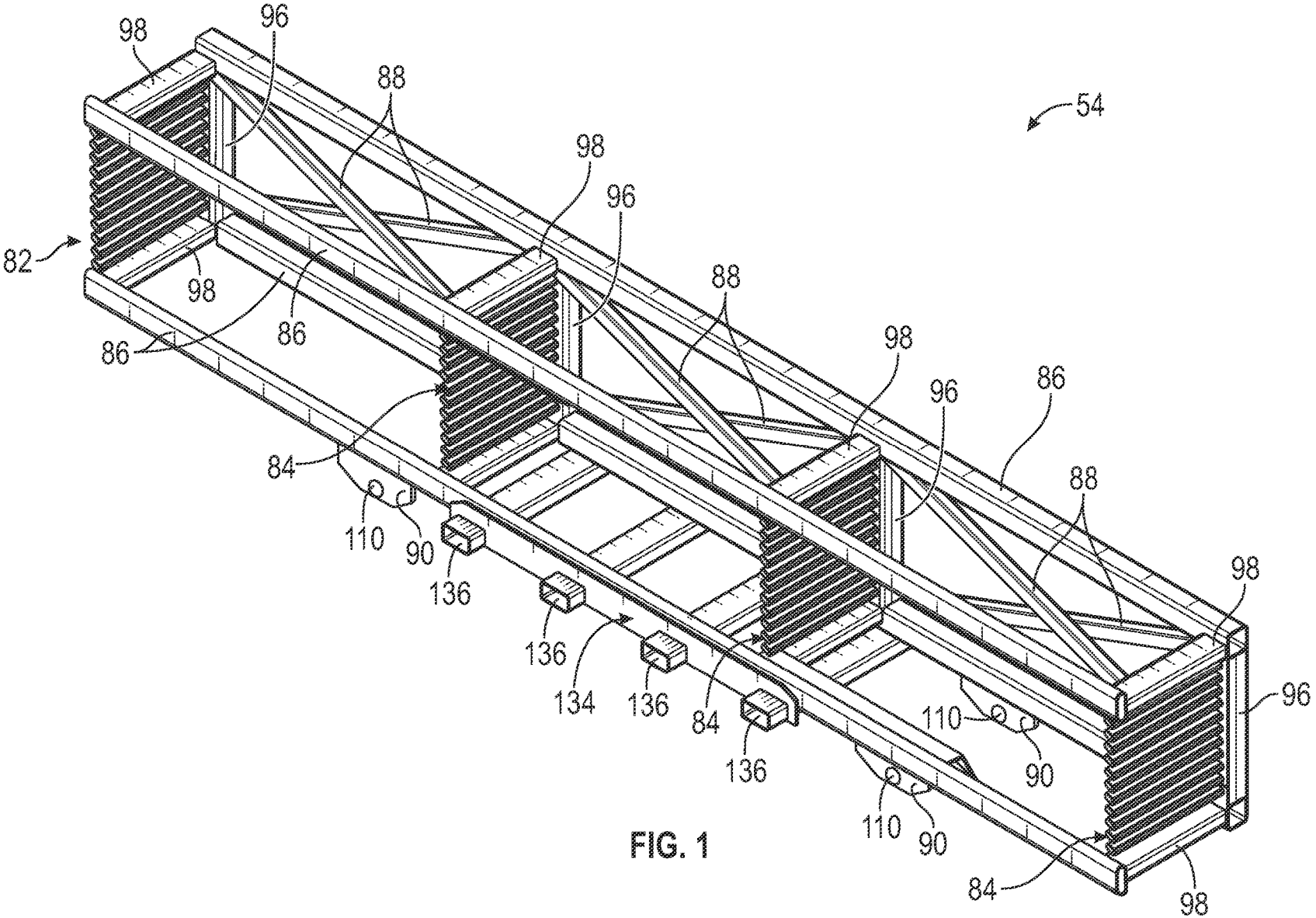
FIG. 1 is a top perspective view of an exemplary rod crate.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION

This disclosure describes a system and methods of use that replace the conventional practices of installing, removing, transporting, and storing of elongated members such as sucker rods. The described apparatuses and practices improve the longevity of sucker rods, reduce worker fatigue, and create efficiencies associated with the handling of sucker rods in the oil field industry.

Increasing the longevity of rods is achieved by limiting the stress or damage induced during the rod installation and removal processes. The described system and methods significantly reduce stress by providing proper support and storage of the rods in a rod crate as they are installed and removed from the wellbore, as well as during storage and transport. The described methods eliminate the conventional practice of tailing rods and allows the process of up righting and laying down rods to be completed without stressing the rod and while providing continuous proper support.

The system includes a crate and deployer designed to be used during the rod installation, removal, transportation and storage process. The crate and deployer are set proximate a wellbore, where the rods are hung vertically as they would be in the wellbore; thus, by design, the rods do not bend or bow. This orientation removes the stresses associated with the conventional method of tailing the rods. When the rods are stored, the crate is articulated into a horizontal position, in which the rods are in the horizontal position as well. The crate is designed to provide the proper support as outlined in API RP 11BR while the rods are in a horizontal, vertical, or any orientation in between. The crate is further designed to secure the rods as they are moved, such as during articulation or transportation. In the drawings, the crate 54 is generally shown empty (without rods 78 therein) so that its structure is more clearly visible. However, it is to be understood that in many stages of use, crate 54 will be partially or fully filled with rods 78.

Rod installation uses an elevated worker on a platform to move individual rods from the crate under the power of an air actuated lift cylinder line to the rig's lifting equipment. The rod is then lowered to above the wellbore, where its bottom end is screwed to another rod previously installed or to pumping equipment. The process of screwing the rods together or to the pump is the same process as previously described in the conventional process. For rod removal from the wellbore, the elevated worker removes the top of the rod from the rig's lifting equipment using the associated lifting cylinder and places the rod into the crate. The process is repeated until all the rods are removed from the wellbore. Since the workers no longer tail rods across the ground surface, worker fatigue and the time associated with a tailing process are greatly reduced.

In an exemplary embodiment, many rods can be moved at once with powered equipment such as a loader having wheels or a ground-engaging track. The crate is equipped with stake pockets, allowing the wheeled loader to lift a crate (whether loaded with rods or not) and either move it around the location or onto a transport trailer or deployer. For example, a full crate of rods can be moved by the loader to a nearby location, or moved by the loader to a transport trailer for longer distance moves. The crates are designed to fit onto a typical flatbed trailer and is easily secured to it following FMCSA requirements. Once on the trailer, a worker can easily secure a crate to the trailer.

Another efficiency gain is seen in the rod preparation process. Instead of transporting the rods to the well location, the system allows the crated rods to be shipped to an alternate location, where they can be processed by another party. This allows the preparation to be completed while the rig crew is completing other essential tasks, resulting in less rig downtime and reduced labor costs of the rig crew.

An exemplary rod handling system 50 includes two equipment elements: a deployer 52 and an associated rod crate 54. As shown in FIGS. 5-12 and 17, in an exemplary embodiment, deployer 52 is configured as a trailer designed to travel over the road, towed by a semi-trailer truck 56. Deployer 52 in an exemplary embodiment has outriggers 58, bed frame 60, working platform 62, support bracket 63, crate support frame 64 with securement pins 66 in crate attachment bracket 68, platform brace 67, dual hydraulic cylinders 70, ladder 72, hydraulic scoping cylinder 74 and ground engaging wheels 76.

Figure 6:
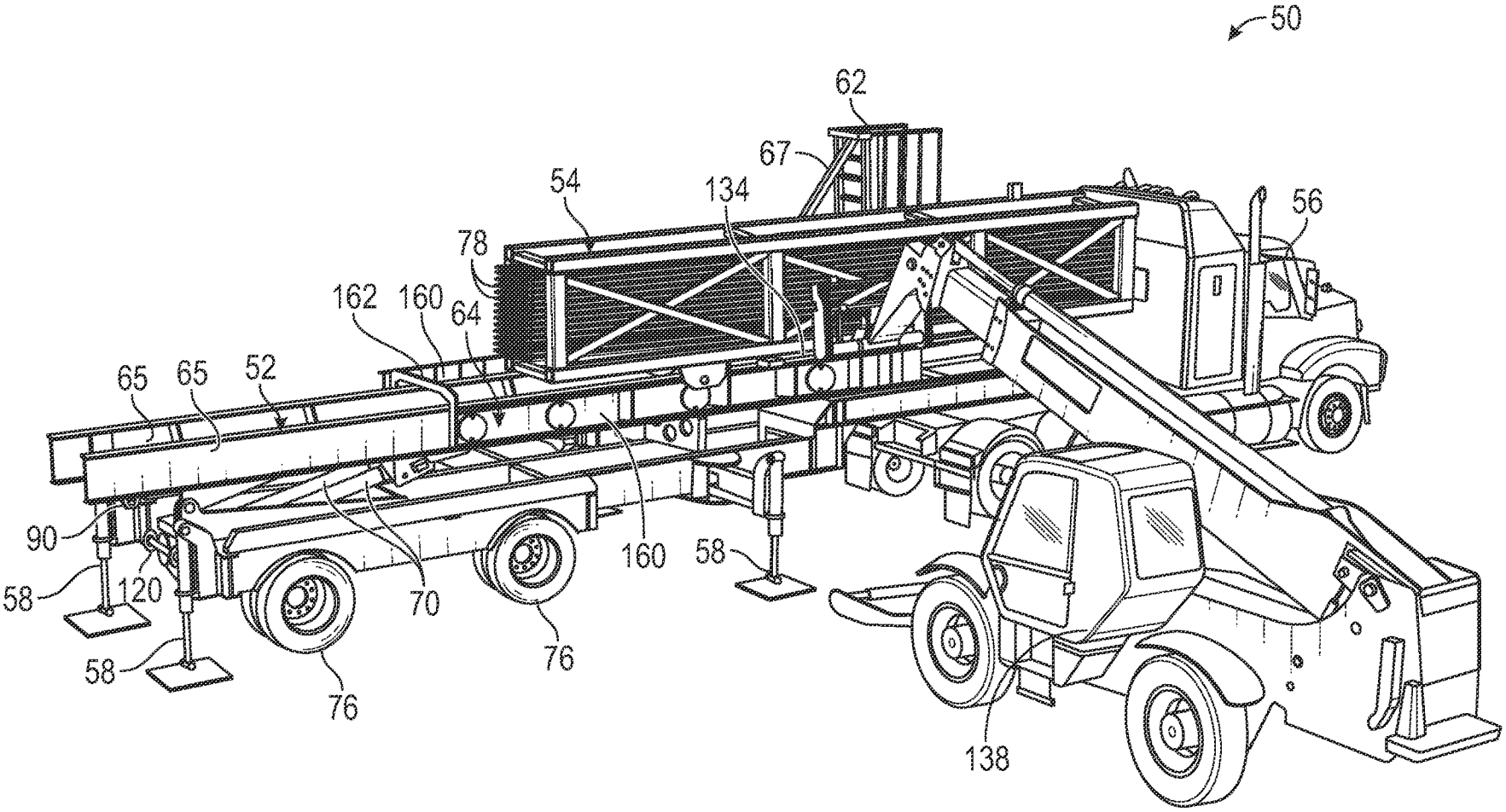
FIG. 6 is a side perspective view of a loader moving a crate onto the exemplary deployer (viewed from an opposite side compared to FIG. 5).
Figure 7:
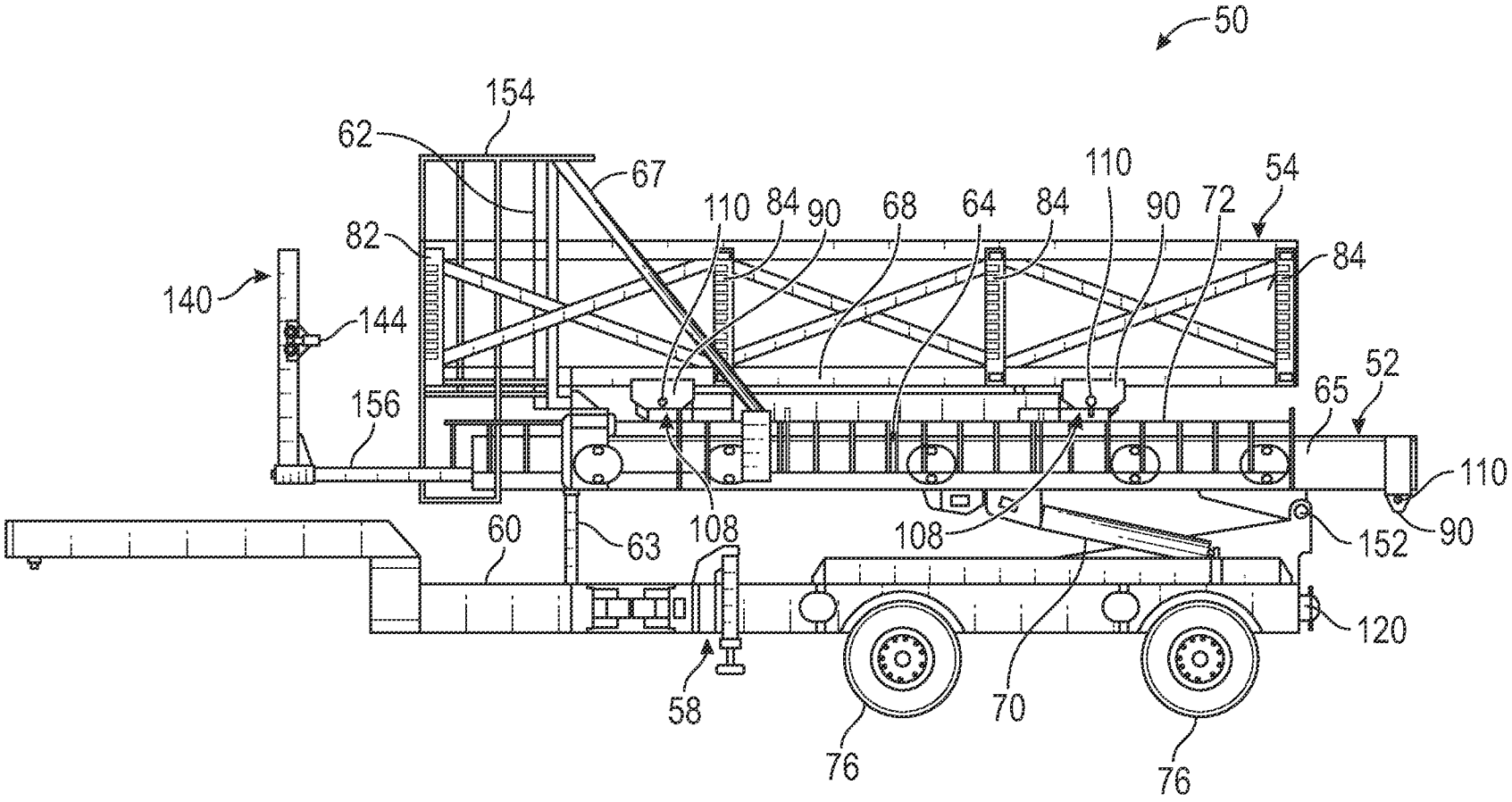
FIG. 7 is a side elevation view of the exemplary deployer with a rod crate in a horizontal position, viewed from the same perspective as FIG. 5.
Figure 8:
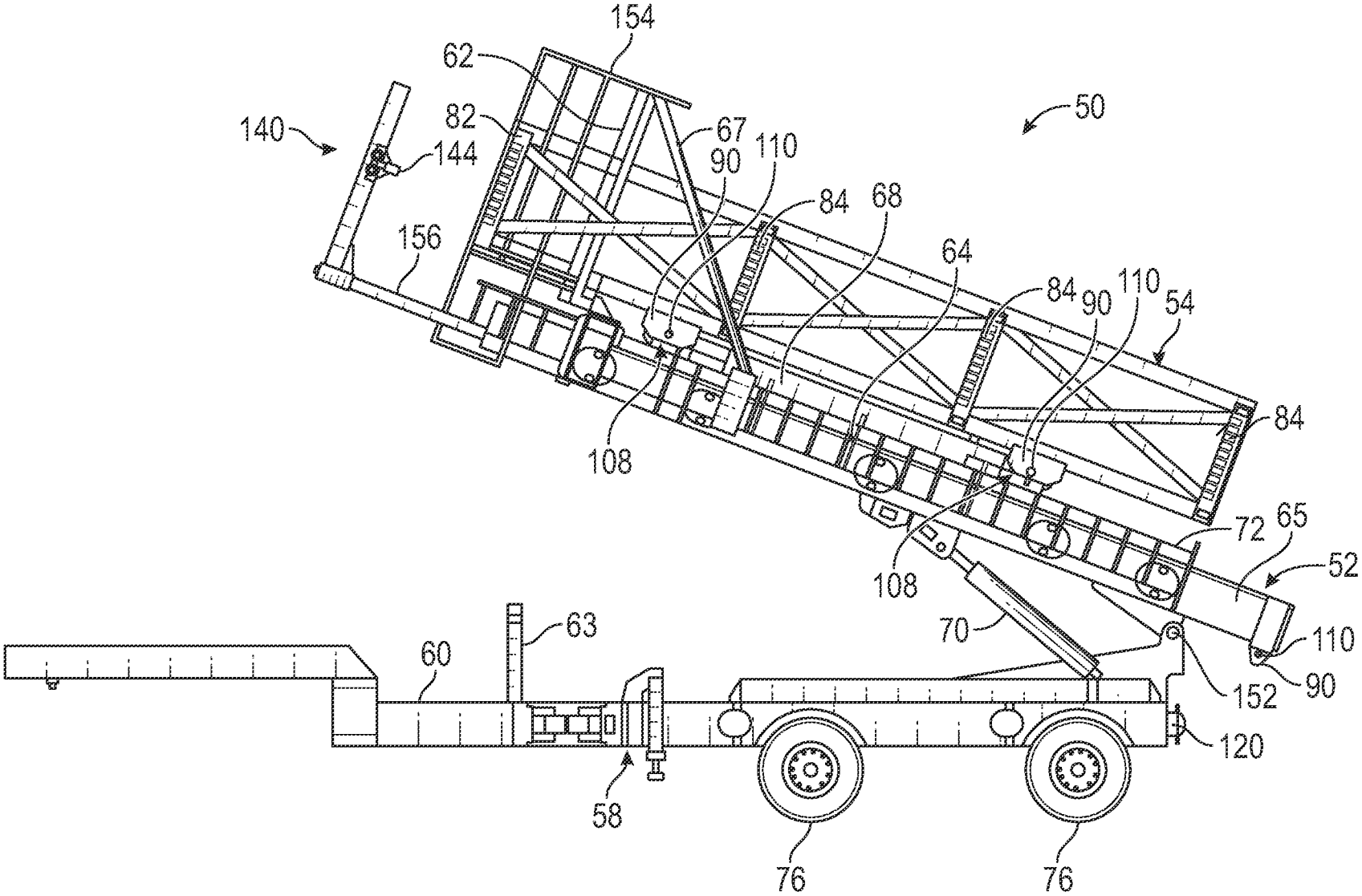
FIG. 8 is a side elevation view of the exemplary deployer with a rod crate being raised from the horizontal position.
Figure 9:
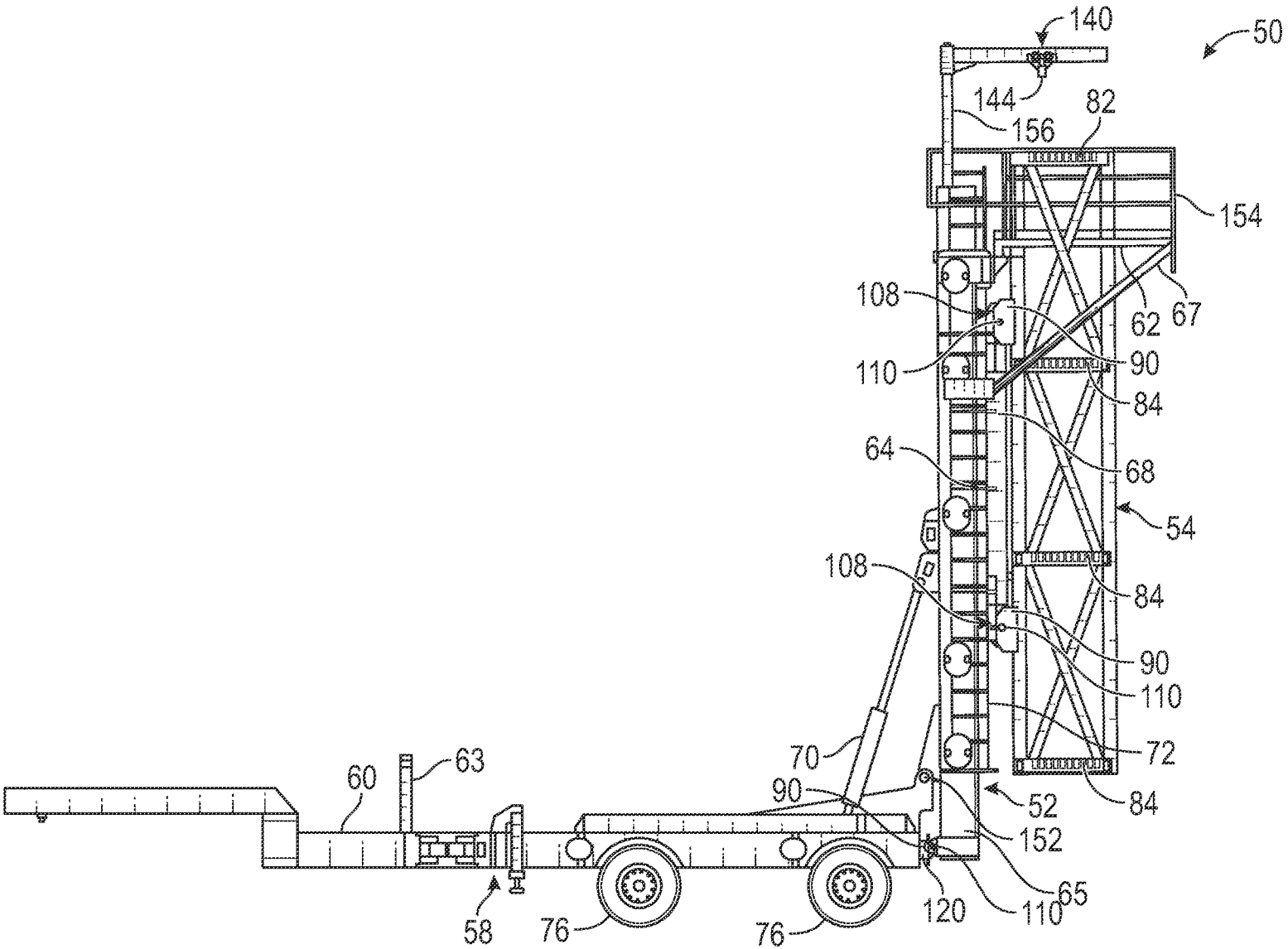
FIG. 9 is a side elevation view of the exemplary deployer with a rod crate in a vertical position.
Figure 10:
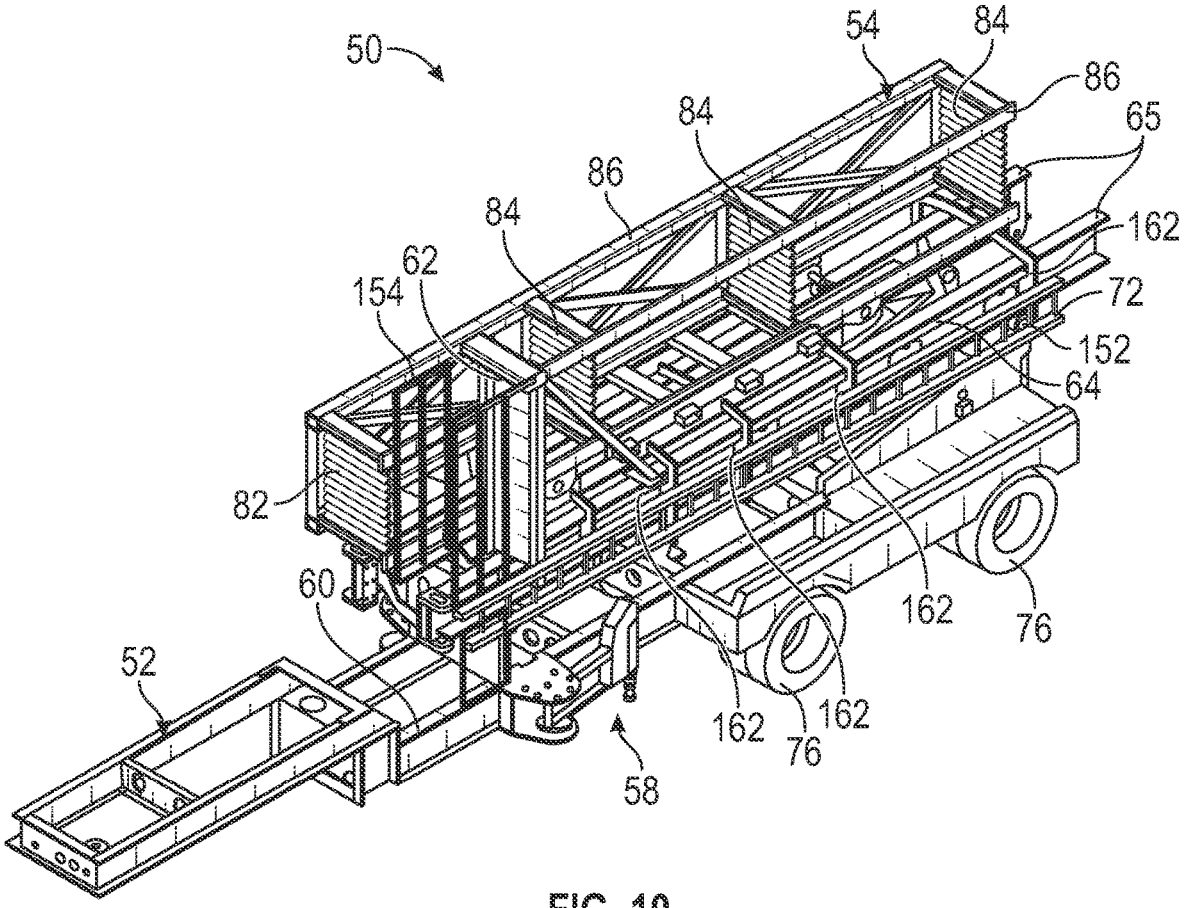
FIG. 10 is a perspective view of the exemplary deployer with a rod crate in a horizontal position.

The rod crate 54 is designed to securely hold many rods 78 simultaneously, whether in a vertical position as shown in FIGS. 9, 11, 12, and 17-20; a horizontal position as shown in FIGS. 6, 7, and 10; or an intermediate position as shown in FIG. 8; while providing support along the length of the rods 78, thereby minimizing stress and potential damage to the rods 78. In an exemplary embodiment, crate 54 is a steel structure, approximately 24 feet (7.3 m) by 4 feet (1.2 m) by 3 feet (0.9 m) and is configured to be used in the vertical position (24 feet (7.3 m) in height) during rod installation or removal from the wellbore 80 and in the horizontal position (4 feet (1.2 m) in height) when the rods are to be stored or transported. Thus, in one embodiment, the length of crate 54 is sufficient to hold many single rods 78. In the vertical position, the single rods 78 hang side-by-side, as shown in FIGS. 17-20. In the horizontal position, as shown in FIG. 6, the single rods 78 lay side-by-side, wherein rows of rods are aligned by rod support 82 and rod guides 84. In the vertical position, as shown in FIGS. 17-20, the single rods 78 hang by a top rod support 82 and are spaced by intermediate and bottom rod guides 84. While exemplary embodiments of crate 54 are described, it is contemplated that different dimensions and capacities can be provided to accommodate various rod diameter sizes and numbers of rods. Moreover, other materials can also be used.

Figure 2:
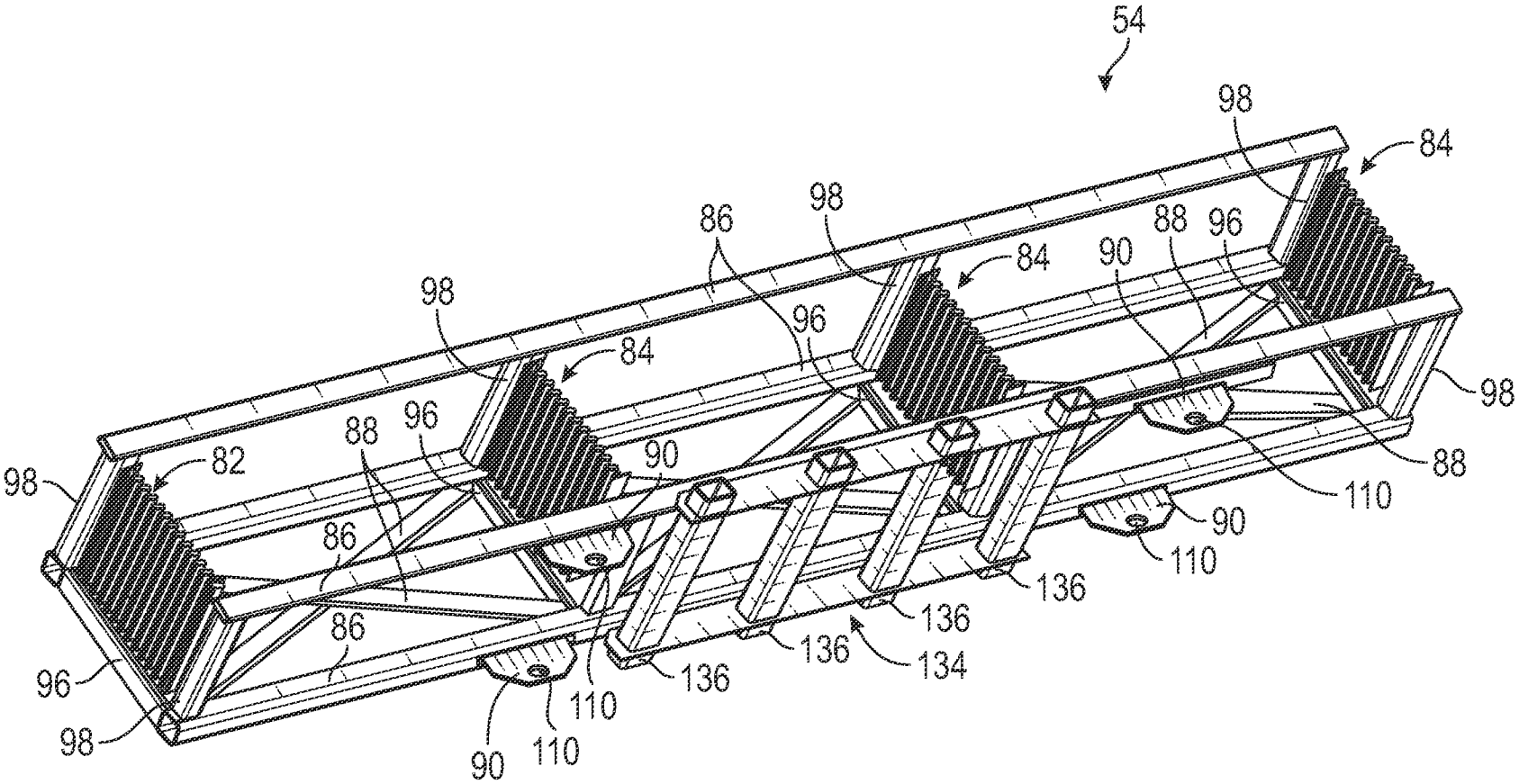
FIG. 2 is a bottom perspective view of the exemplary rod crate.

FIG. 1 is a top perspective view, and FIG. 2 is a bottom perspective view, of an exemplary crate 54. In an exemplary embodiment, crate 54 includes a plurality of elongated frame members 86 connected to each other in a block configuration at rod support 82 and rod guides 84. Moreover, bracing members 88 are provided on a back side of the crate 54. A front side of the crate, which is opposite the back side, remains open for the insertion of rods 78 between fingers of the rod support 82 and rod guides 84. As shown in FIGS. 1-3B, the crate 54 has a built-in rod support 82, configured with parallel support fingers 92 that allow many rods to be hung vertically within the crate 54.

Figure 3A:
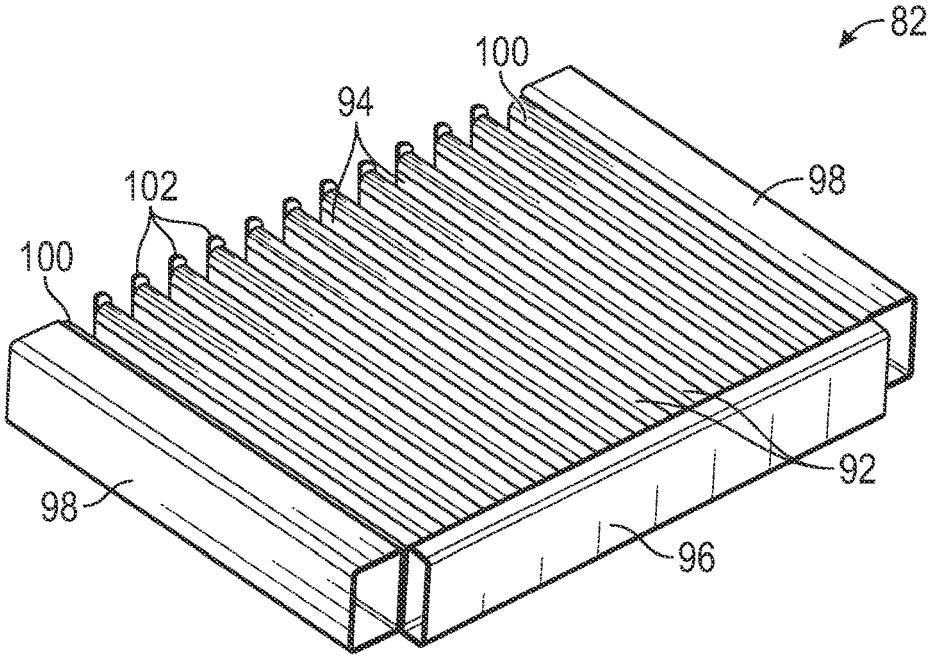
FIG. 3A is a top perspective view of an exemplary rod support.

FIG. 3A is a top perspective view of rod support 82, which is disposed at a top end of crate 54 when the crate 54 is vertical. As shown in FIG. 3A, rod support 82 includes a back frame member 96 and two side frame members 98.

Figure 3B:
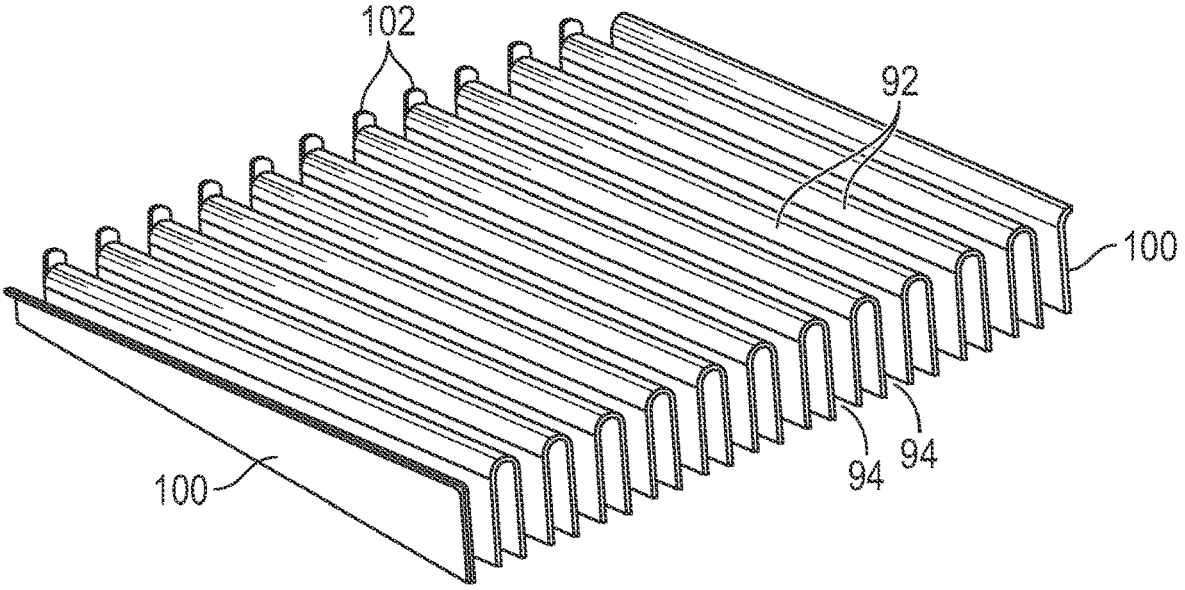
FIG. 3B is a view of the support fingers of the rod support of FIG. 3A.

FIG. 3B shows the plurality of support fingers 92 removed from the back frame member 96 and two end support finger portions 100 removed from the side frame members 98. In an exemplary embodiment, each of support fingers 92 and end support finger portions 100 has a greater height dimension near the back end thereof compared to the front end thereof. Thus, a strong attachment of support fingers 92 to back frame member 96 is provided while allowing for savings in materials and weight at the open, cantilevered front end. In an exemplary embodiment, each of the support fingers 92 at its front end includes a protrusion 102 to prevent unintentional sliding of a rod 78 out of the open front end.

Figure 4A:
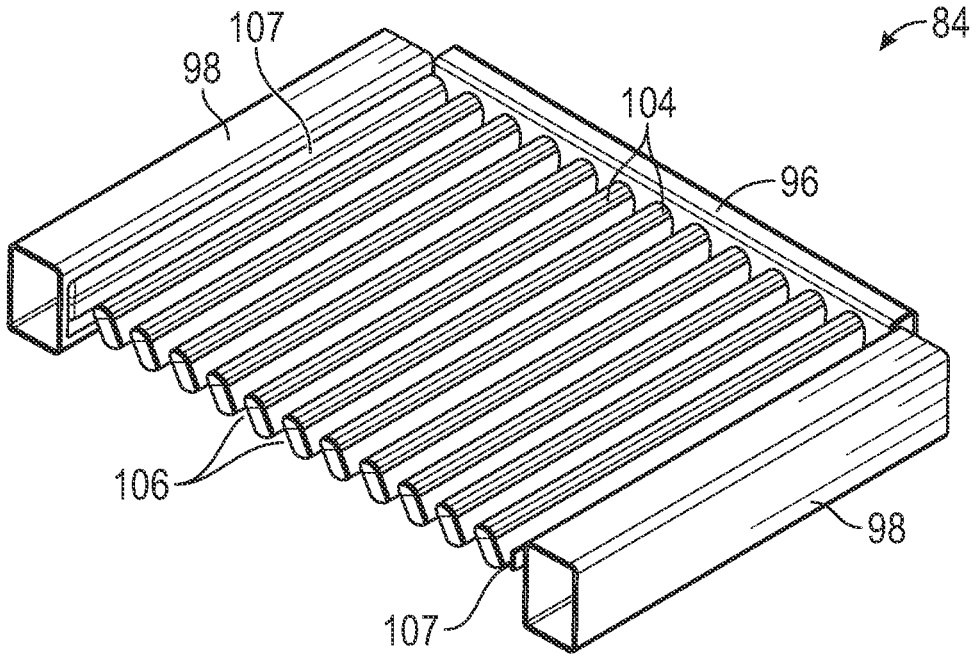
FIG. 4A is a top perspective view of an exemplary rod guide.
Figure 4B:
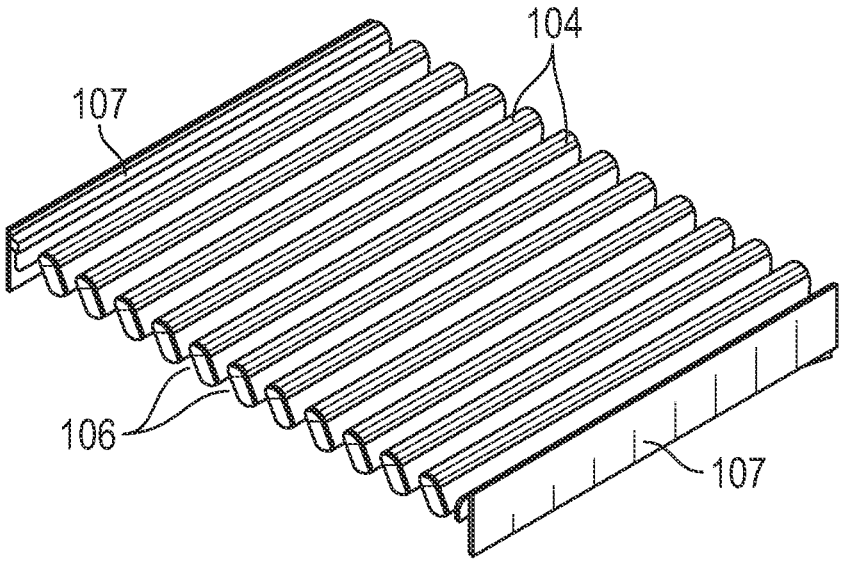
FIG. 4B is a view of the guide fingers of the rod guide of FIG. 4A.

FIG. 4A is a top perspective view of rod guide 84, which is disposed at a bottom end of crate 54 when the crate 54 is vertical, and at two equally-spaced, intermediate positions along a length of crate 54. As shown in FIG. 4A, rod guide 84 includes a back frame member 96 and two side frame members 98. FIG. 4B shows the plurality of guide fingers 104 removed from the back frame member 96 and two end guide finger portions 107 removed from the side frame members 98. In an exemplary embodiment, each of guide fingers 104 is attached to back frame member 96 and has an open, cantilevered front end.

The crate 54 is configured with rod guides 84 aligned with the rod support 82 so that the slots 94, 106 are aligned for the receipt of rods 78. The rod guides 84 are strategically positioned to provide support as outlined by API RP 11BR while the rods 78 are in the horizontal position, such as while being stored or while in transit. Exemplary embodiments of crate 54 are capable of securely storing and protecting about 11 to 15 rows of rods or between about 132 and 195 rods, depending on the rod size or model of crate.

In an exemplary embodiment, slot pockets 94 are closely dimensioned to hold the tops of rods 78 in a hanging configuration, as shown in FIGS. 18, 19 and 21-22B, for example. The precise placement of the tops of rods 78 on rod support 82 allow for careful alignment of the rods 78. Moreover, the use of cribbing bars 166 (labeled in FIG. 21) across each row of filled rods, wherein a row is perpendicular to a slot pocket 94, 106, spaces each of the plurality of rods 78 from the other rods. Intermediate portions and lower ends of each of the rods 78 is received into a slot pocket 106 of a rod guide 84. In an exemplary embodiment, a width of each guide finger 104 is narrower than that of a corresponding support finger 92 so that slot pockets 106 are slightly wider than slot pockets 94. The slot pockets 106 of rod guide 84 are wider than the slot pockets 94 of rod support 82 to allow for ease of insertion without undue contact between the rods 78 and guide fingers 104. Because the guide fingers 104 do not support the weight of the rods as do the support fingers 92, the guide fingers 104 can be less robust (narrower in width and height) than the support fingers 92.

As shown in the embodiment of FIGS. 3A and 3B, in an exemplary embodiment, there are eleven support fingers 92 and two end support finger portions 100, creating twelve slot pockets 94 therebetween, each about 1 inch wide, into which the rods 78 may be slid. In an exemplary embodiment, each of the slot pockets 94 has a capacity of about fifteen rods. When the crate 54 is filled, it is then secured with built-in lock bars 170 (shown in FIGS. 22A and 22B). In an exemplary embodiment, lock bars 170 are installed on the open side of crate 54, opposite back frame member 96, at the top and bottom of crate 54. Closing locks bars 160 prevents the rods 78 from sliding out, especially when crate 54 is in motion, such as when the crate 54 is being transported or articulated either to the horizontal or vertical position.

As shown in FIGS. 1 and 2, in an exemplary embodiment, the crate 54 features four pin receivers 90 that allow the crate 54 to be detachably secured to the deployer 52 (see FIGS. 7-10). In an exemplary embodiment, the pin receiver 90 is configured as a flange having a heavily reinforced port 110 into which a large pin 66 can be set. The pin 66 is part of the crate lock 108 of the deployer 52, thereby securing the crate 54 to the deployer 52 (see FIGS. 13B-14B).

Figure 13A:
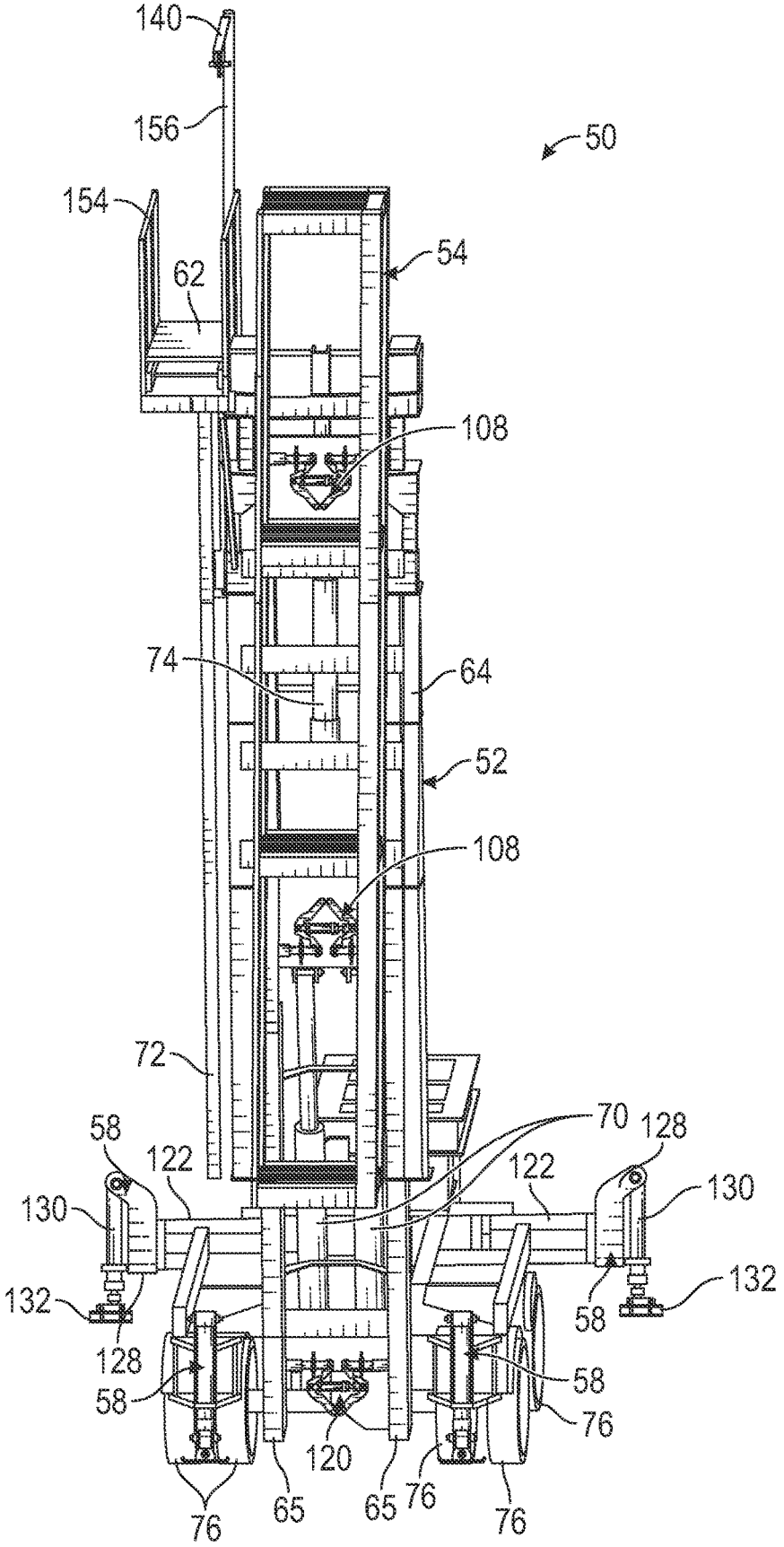
FIG. 13A is a back-end elevation view of the exemplary deployer in the configuration of FIG. 12.
Figure 13B:
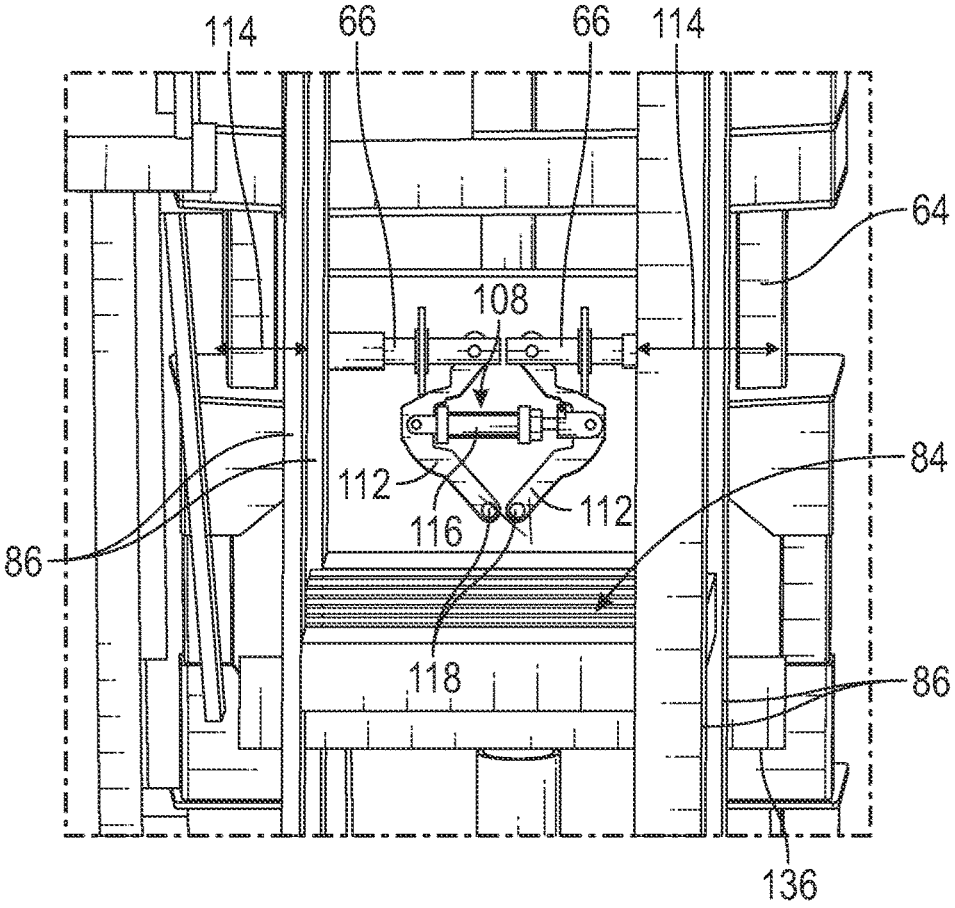
FIG. 13B is an enlarged view of a portion of FIG. 13A, showing a crate lock in an unlocked configuration.
Figure 13C:
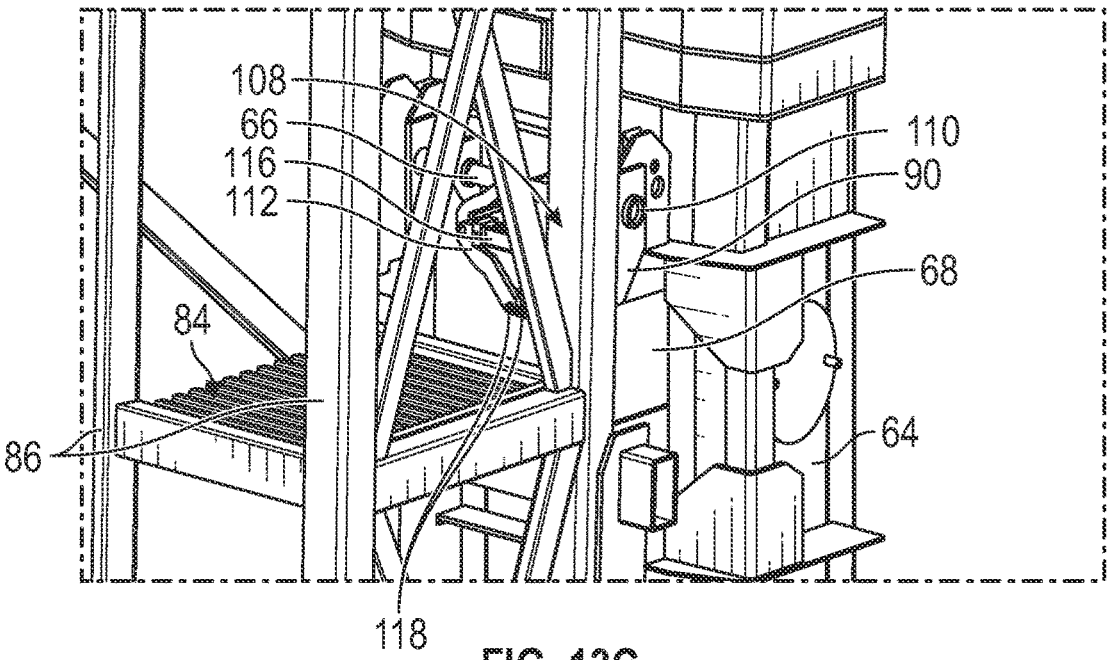
FIG. 13C is a perspective view of the portion of the deployer shown in FIG. 13B.

FIG. 13A is a rear view of rod handling system 50, showing two crate locks 108. FIG. 13B is an enlarged portion of FIG. 13A, showing an upper crate lock 108. FIG. 13C is a perspective view of the crate lock 108. In FIGS. 13A-13C, the lock 108 is in an unlocked position, wherein pins 66 have not been extended into port 110 of pin receiver 90. In an exemplary embodiment of crate lock 108, each pin 66 is pivotally connected to linkage 112 so that pin 66 moves transversally in directions 114 as lock cylinder 116 expands and retracts. Linkage 112 is pivotally connected at its other end to a fixed location 118 on deployer 52. FIGS. 13A-13C show the crate lock 108 in an unlocked position, wherein pin 66 is not received through port 110 of pin receiver 90 and an aligned port of crate attachment bracket 68.

Figure 14A:
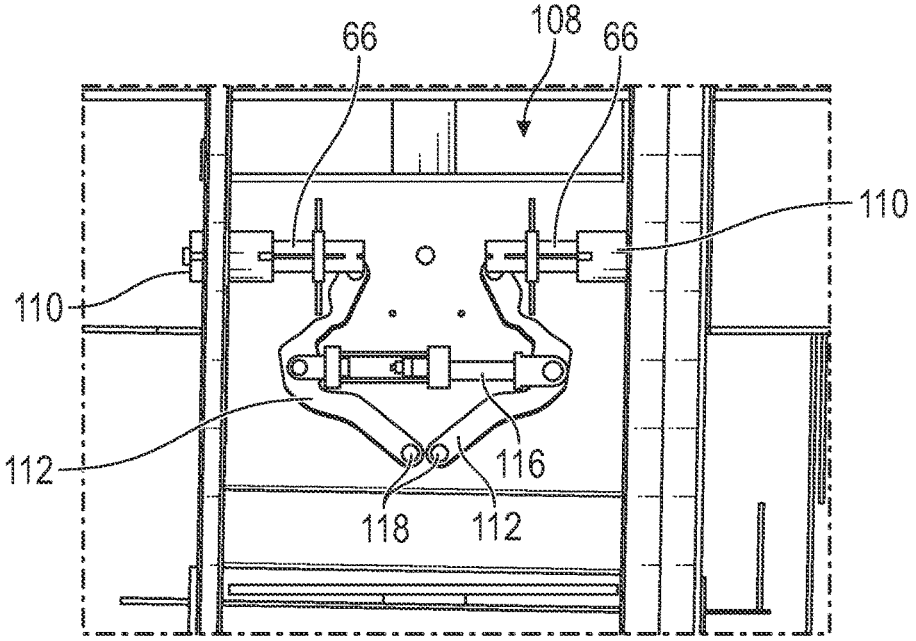
FIG. 14A is similar to FIG. 13B but shows the upper crate lock in a locked configuration.
Figure 14B:
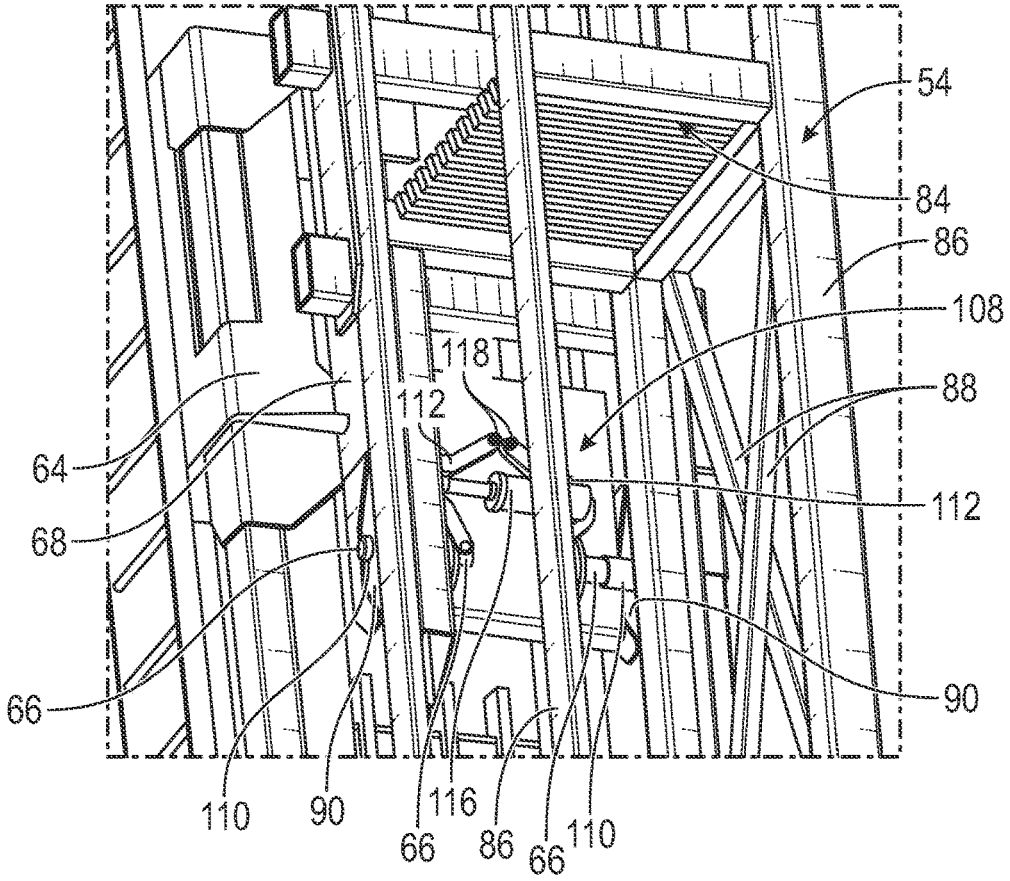
FIG. 14B shows a perspective view of the lower crate lock of FIG. 13A in a locked configuration.

FIGS. 14A-14B show a locked configuration of each crate lock 108, wherein lock cylinder 116 is extended, to thereby move pins 66 into and through ports 110 of pin receivers 90 and aligned ports of crate attachment bracket 68. Thus, in the locked configuration of FIGS. 14A and 14B, crate 54 is locked to deployer 52. The drawing figures illustrate the locking and unlocking features of the upper (FIG. 14A) and lower (FIG. 14B) crate locks 108 with the crate 54 in the vertical position for easy viewing. However, it is to be understood that in actual implementation, the crate 54 would be locked to deployer 52 after the crate is positioned onto the deployer, as shown in FIG. 6, and before the activation of lift cylinders 70.

Figure 5:
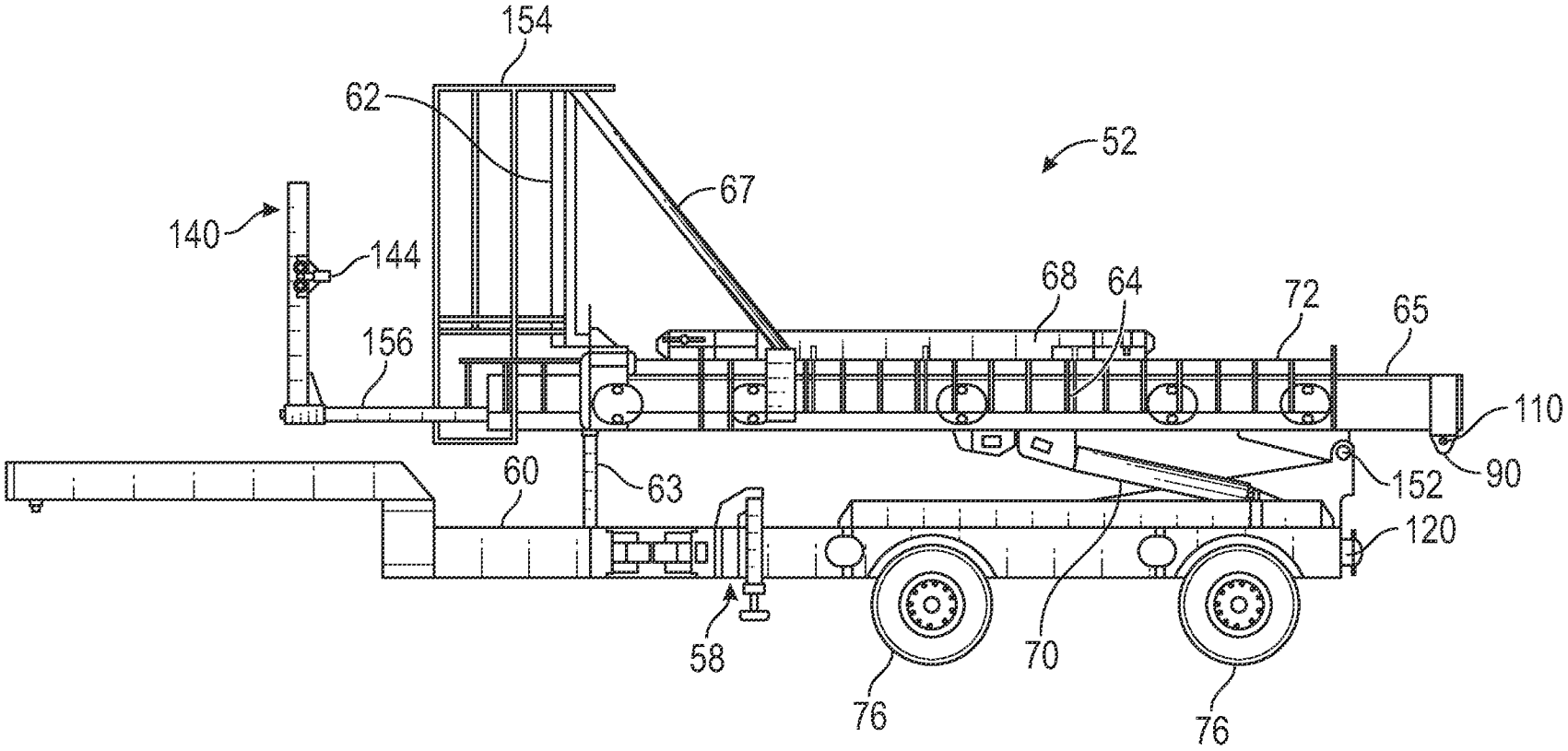
FIG. 5 is a side elevation view of the exemplary deployer.
Figure 11:
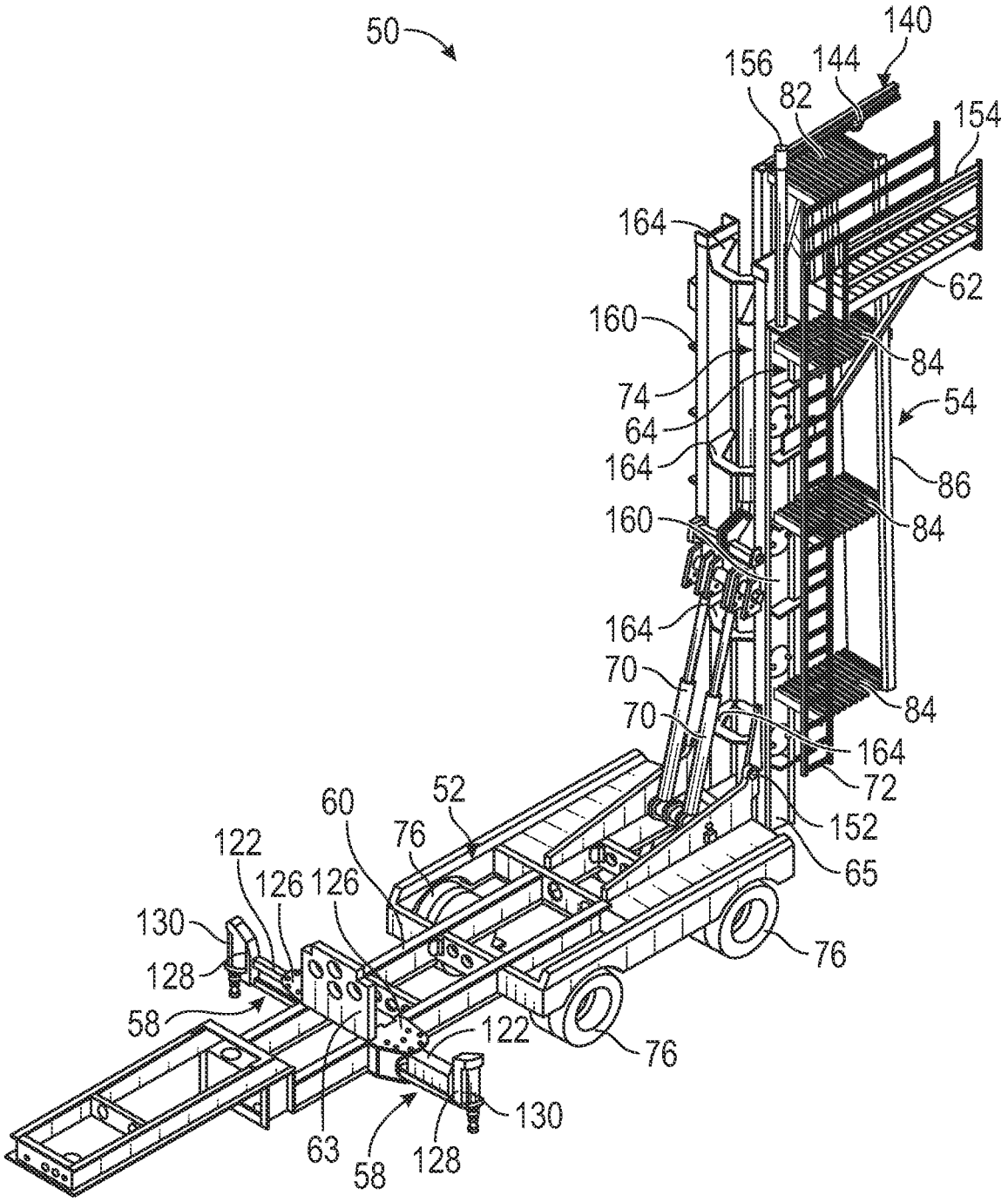
FIG. 11 is a perspective view of the exemplary deployer with a rod crate in a vertical position and with the scoping cylinder retracted.
Figure 12:
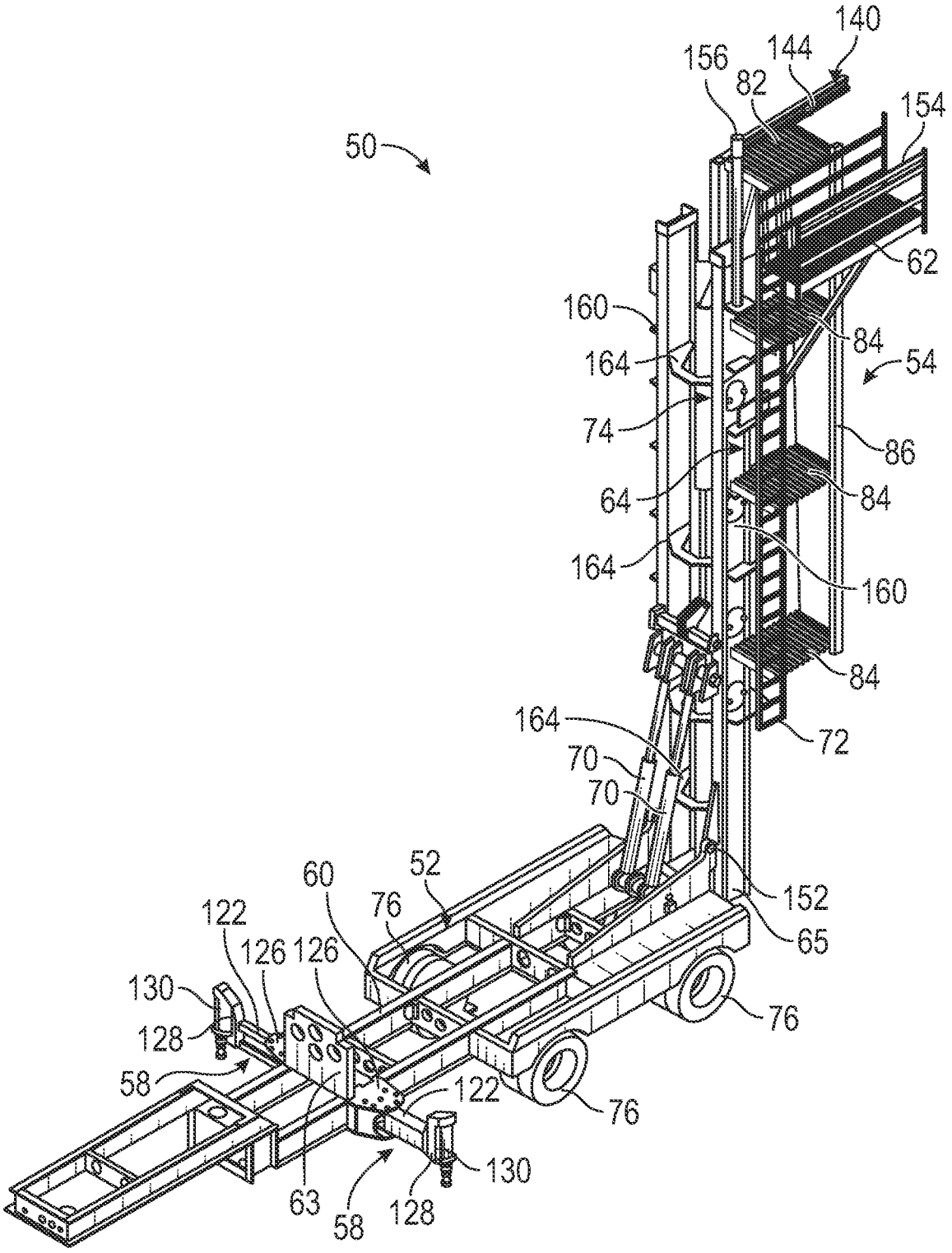
FIG. 12 is a perspective view of the exemplary deployer with a rod crate in a vertical position and with the scoping cylinder extended.
Figure 15:
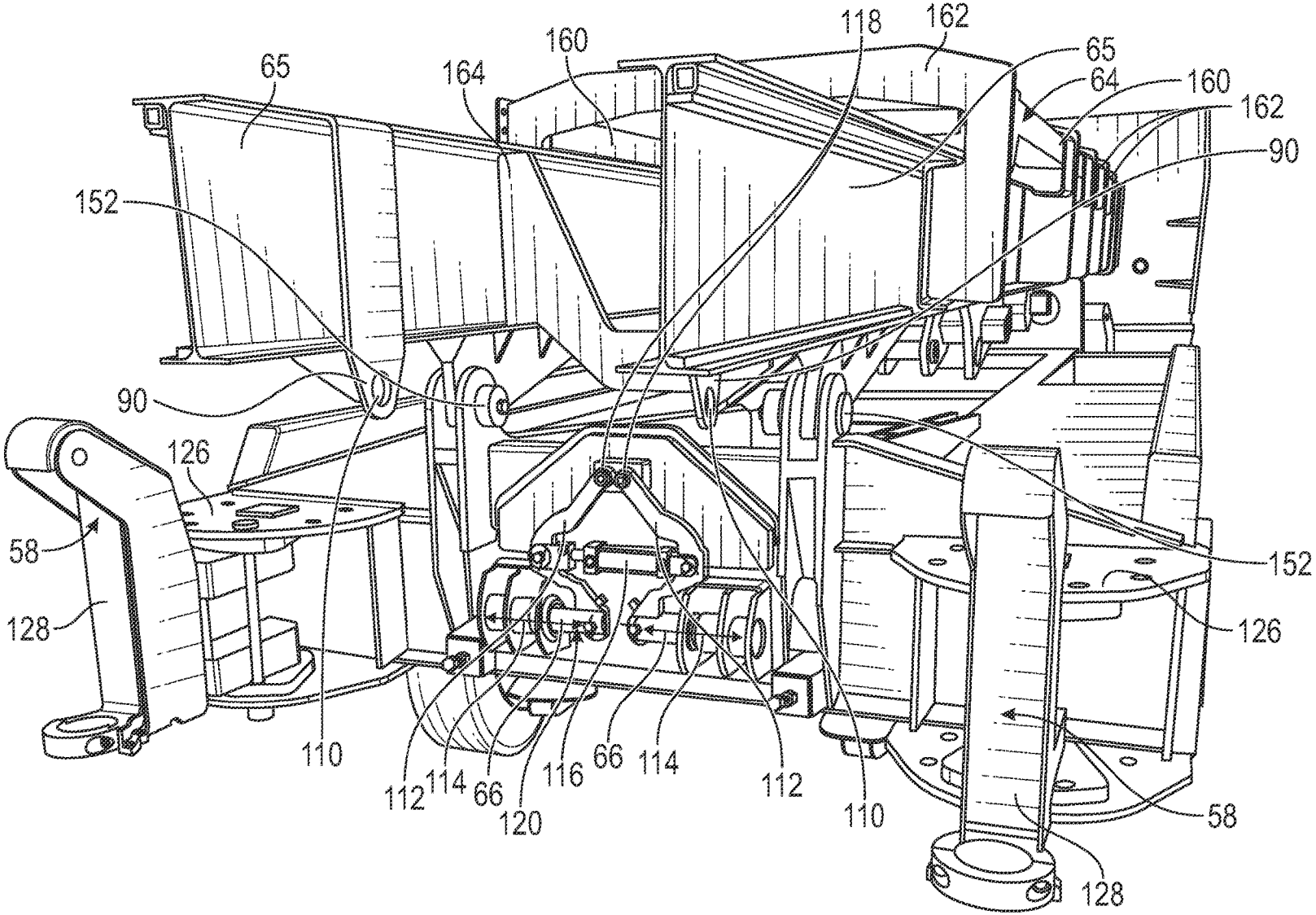
FIG. 15 is an end perspective view of the deployer with the crate support frame in a horizontal position.

FIG. 15 is a rear perspective view of a deployer 52 with crate support frame 64 in a horizontal position (as in FIG. 5). Some elements of outriggers 58, such as cylinders 130, ground engaging plates 132 and pivotal connections 158, are not shown. Mast lock 120 is provided to lock the deployer 52 in a vertical position, as shown in FIGS. 9 and 11, for example. The operation of mast lock 120 is similar to that for crate lock 108, and similar parts are given the same reference number. In an exemplary embodiment of mast lock 120, each pin 66 is pivotally connected to linkage 112 so that pin 66 moves transversally in directions 114 as lock cylinder 116 expands and retracts. Linkage 112 is pivotally connected at its other end to a fixed location 118 on deployer 52. FIG. 15 shows the mast lock 120 in an unlocked position, wherein pin 66 is not received through port 110 of pin receiver 90 of crate support rails 65. After lift cylinders 70 are actuated to move crate support rails to a vertical position so that ports 110 of pin receivers 90 are aligned with pins 66, lock cylinder 116 is extended. This action moves pins 66 into and through ports 110 of pin receivers 90 of crate support rails 65. Thus, the crate support rails 65 are locked vertically, to the back end of bed frame 60, as shown in FIGS. 9, 11-13A, 17 and 20. The position of the crate support frame 64 can still move vertically as scoping cylinder 74 is extended and retracted, as shown in FIGS. 11 and 12. A suitable lock cylinder 116 includes, for example, a 3000 PSI Rated Tie-Rod commercially available from Prince Manufacturing Corporation of North Sioux City, S. Dak.

Figure 16:
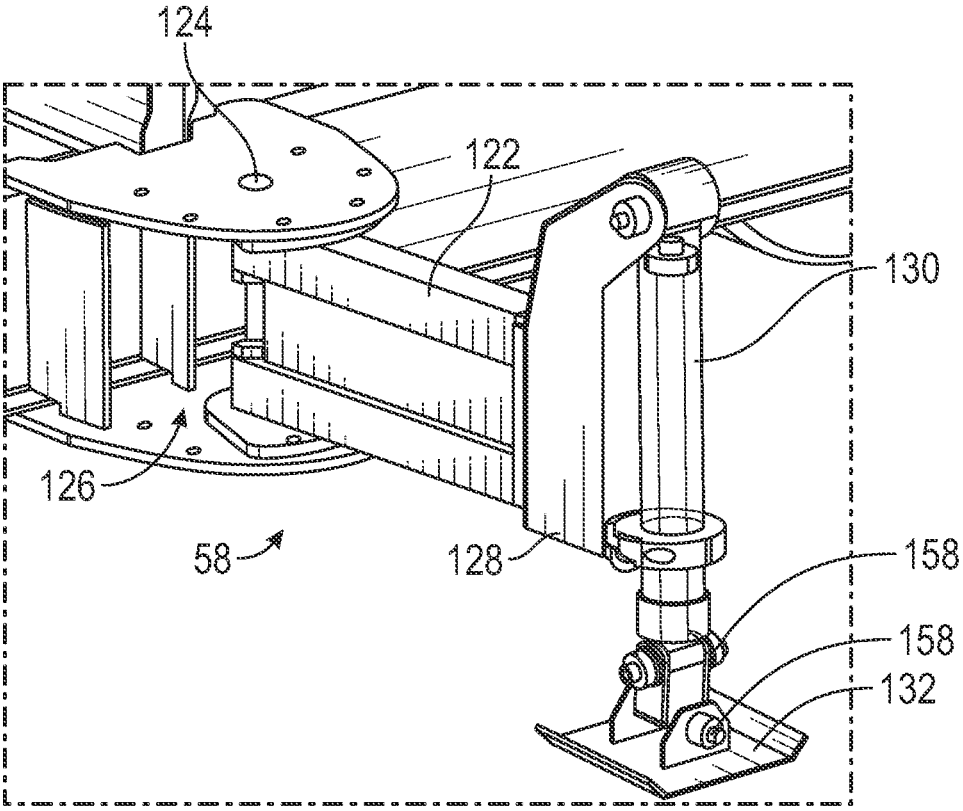
FIG. 16 is a perspective view of an exemplary outrigger.

FIG. 16 is a perspective view of an exemplary outrigger 58, a portion of which is also visible in FIG. 15. In an exemplary use, arm 122 is rotated about pivot axis 124 of outrigger mount 126. Bracket 128 is attached to a distal end of arm 122 and is configured for attachment to hydraulic jack cylinder 130. A bottom end of hydraulic jack cylinder 130 includes a ground engaging plate 132. In an exemplary embodiment, two pivot pin connections 158 are disposed between a bottom of the jack cylinder 130 and the ground engaging plate 132 to allow for tilting in two orthogonal directions to accommodate a non-flat ground surface. In an exemplary embodiment, each of the outriggers 58 is independently actuable to allow for different levels of cylinder extension at each outrigger 58, such as to accommodate for uneven ground surfaces. A suitable cylinder 130 includes, for example, a "Fortress" Welded-DA-Heavy-Duty-3000 PSI cylinder, which is commercially available from Prince Manufacturing Corporation of North Sioux City, S. Dak.

In an exemplary embodiment, crates 54 are designed to allow multiple such crates 54 to be stacked one on top of another (when disposed in a horizontal position) to help minimize storage footprint requirements. In some embodiments, additional bracing members 88 can be attached to the front side of crate 54 after it is filled with rods 78. As shown in FIGS. 1 and 2, in an exemplary embodiment, crate 54 includes loader lift base 134 having fork pockets 136. The base 134 is provided in the form of two parallel flanges connected by tube pockets 136 configured to accept the tines of a fork lift type loader 138 such as shown in FIG. 6. A crate 54, whether empty or partially or fully filled with rods 78, can be easily lifted and moved using the loader 138. Thus, an entire crate 54 of rods can be simultaneously moved from a storage area or onto the deployer 52 under mechanical means.

An exemplary deployer 52 includes equipment that allows the crate 54 to be articulated between the horizontal and vertical positions (such as dual hydraulic lift cylinders 70); an elevated working platform 62 on which a crew member may stand to move rods to and from the crate 54 when in the vertical position; a built in ladder 72 by which to access the platform 62; hydraulic scoping slide or cylinder 74 to raise and lower the crate 54 into the proper position for sucker rod deployment or collection; as well as outriggers 58 to help stabilize the system 50 when the crate 54 is in motion or in the vertical position. Additionally, the deployer 52 is equipped with a jib crane 140 and an associated lift cylinder 142 mounted on trolley 144; these components are used by the worker standing on platform 62 to transfer individual rods 78 into and out of the crate 54.

Figure 17:
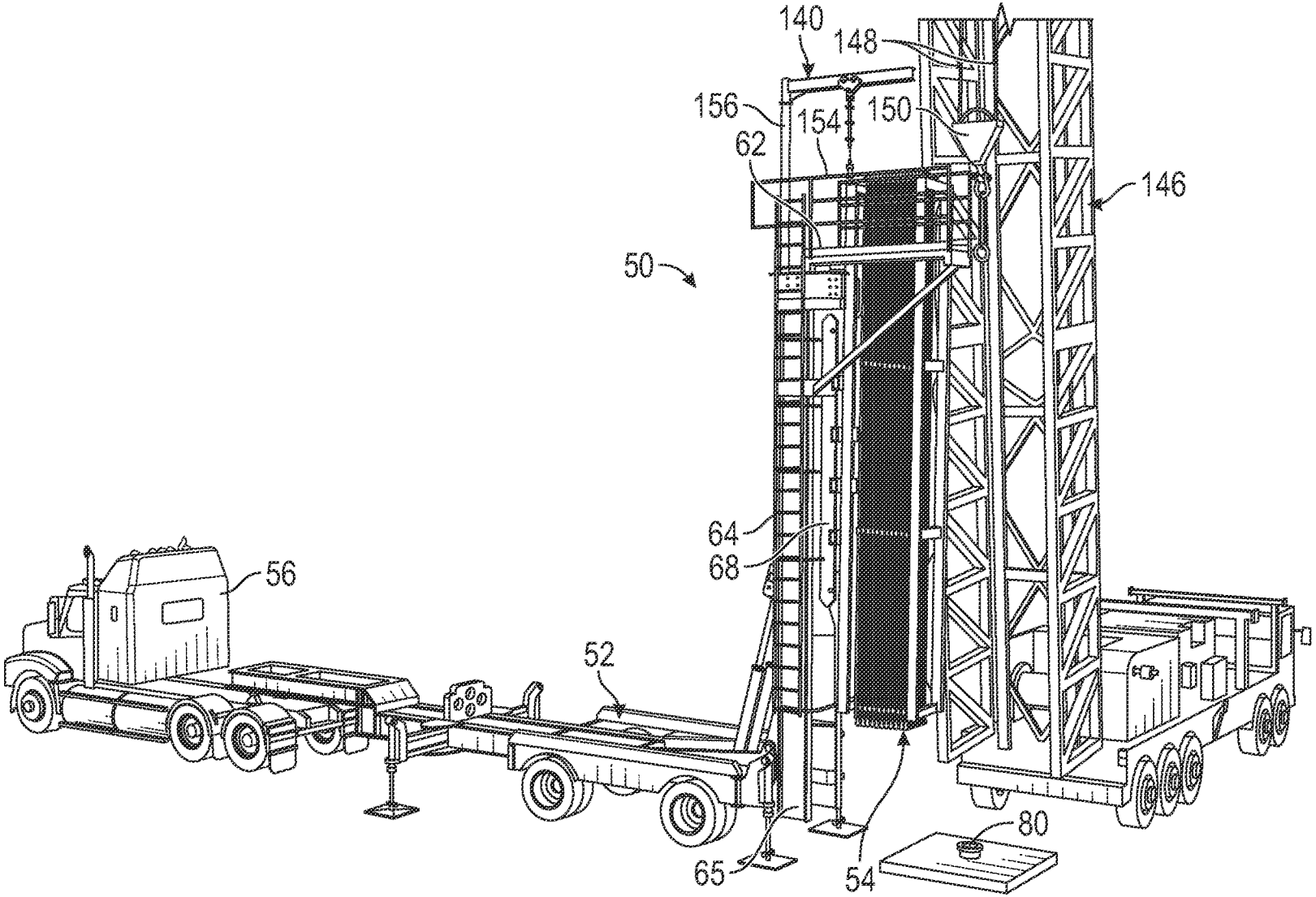
FIG. 17 is a perspective view of an exemplary deployer with a rod crate in a vertical position, and wherein the deployer is positioned for use with a workover rig at a wellbore.
Figure 18:
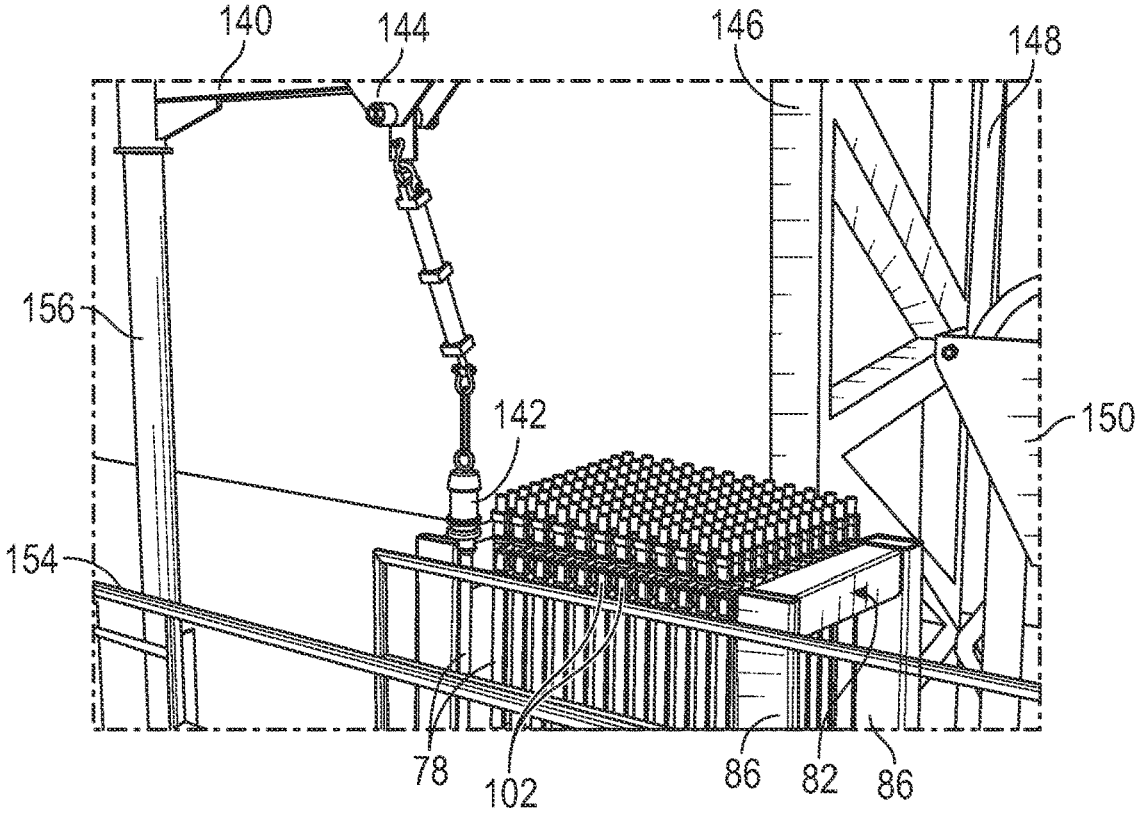
FIG. 18 is a partial perspective view of operation of a jib crane for removing a rod from the rod crate.
Figure 19:
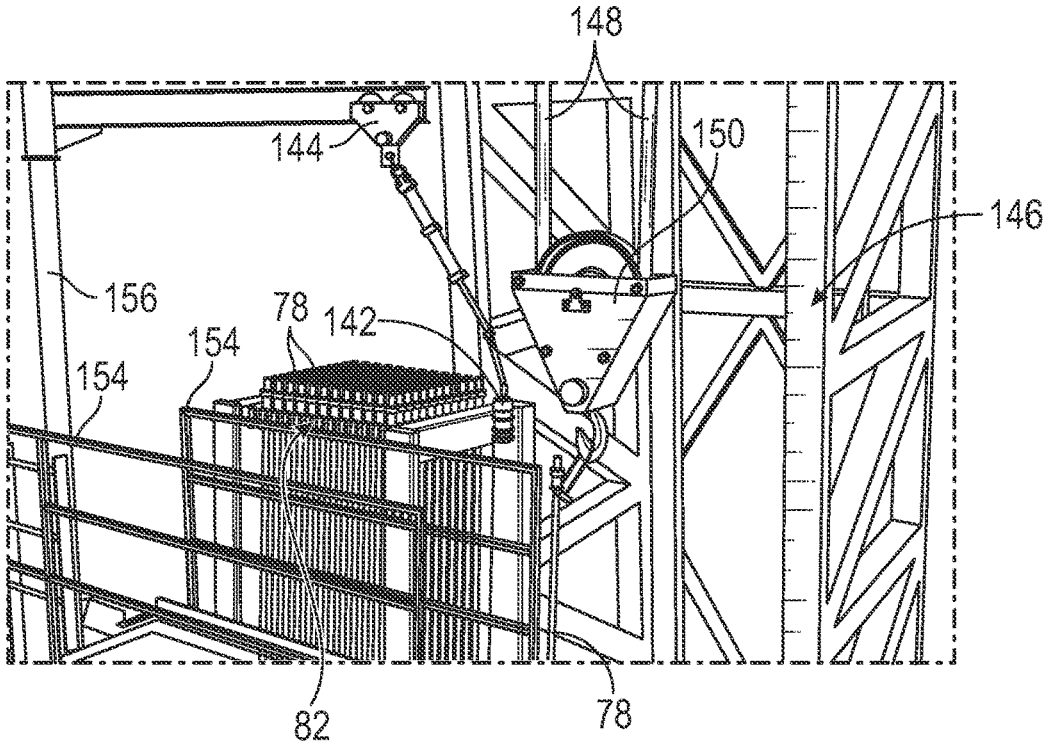
FIG. 19 shows transfer of the rod to a traveling block of the workover rig.
Figure 20:
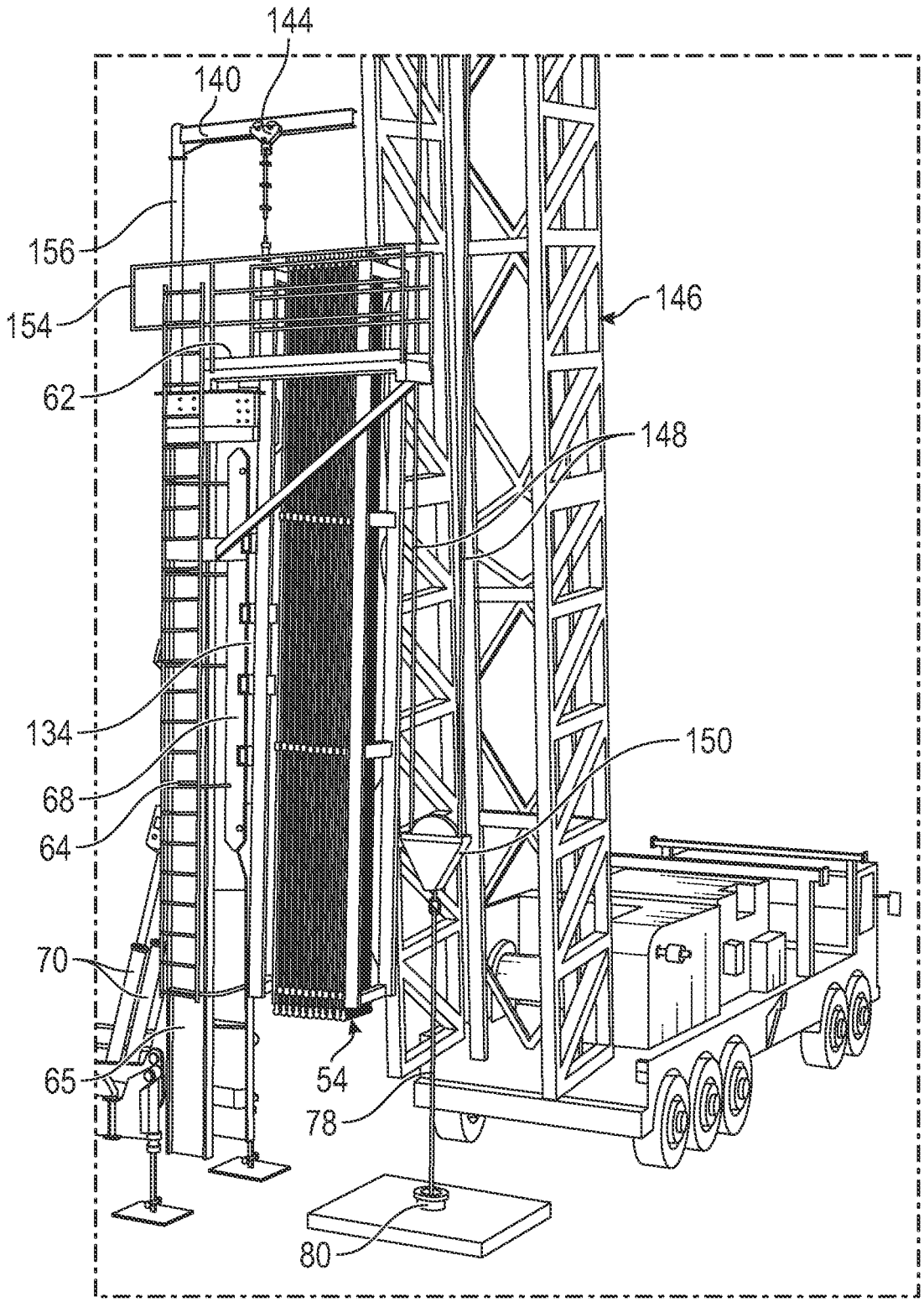
FIG. 20 is a perspective view of the traveling block traveling downward to lower the rod into the wellbore.

In the illustrations, and in particular in FIGS. 17-20, workers are not shown so that the system components are more easily viewed. However, it is to be understood that in a typical operation method, a worker standing on platform 62 controls movement of the jib crane 140 along the trolley mounts 144 to operate the lift cylinder 142, in order to attach and detach rods 78. As shown in FIG. 17, in an exemplary method of use, a semi-trailer driver moves system 50 into position near the wellbore 80 and workover rig 146. A proper position allows an elevated worker standing on working platform 62 to reach the rig's lifting equipment. Once the deployer 52 is in the final position, the forward and rear outriggers 58 are rotated outward and hydraulically extended downward; these actions level, support and stabilize the system 50, such as to prevent it from tipping over under working weight, forces incurred while installing or removing rods, and wind forces.

Drill lines 148 of the workover rig 146 carry traveling block 150, which is designed to latch onto the top ends of rods 78 to lift them up and down (out of and into) the wellbore 80. Referring to FIGS. 17-20, during rod insertion or extraction operations, the system 50 is positioned so that a worker standing on platform 62 can reach a traveling block 150 as it is raised by the drill lines 148 in order to either remove a rod 78 attached to the traveling block 150 or attach a rod 78 to an empty traveling block 150.

The deployer 52 is equipped with crate lock 108 to secure to the crate 54 and allow the crate 54 to be raised into an upright position. In an exemplary embodiment, dual hydraulic tilt cylinders 70 are used to raise and lower the crate support frame 64 (and crate 54 mounted thereon), though other lift mechanisms could be employed. Suitable cylinders 70 include an 8-Inch Bore Welded-Double Acting-3000 PSI cylinder, commercially available from Prince Manufacturing Corporation of North Sioux City, S. Dak. The distal end of the deployer 52 has a hinge 152 that allows the crate support 64 to articulate into the vertical position. Once vertical, mast lock 120 is engaged to lock crate support rails 65 to bed frame 60 to prevent the crate 54 from moving back to the horizontal position.

Once in the vertical position, the height of crate 54 can be adjusted to accommodate the oil well's associated equipment, such as a height of a top of the wellbore 80 from the ground surface, for example. A variety of equipment is found in different oil fields, wherein the wellbore opening can vary significantly in height above the ground surface from one field to another. For example, some wells have blow-out relief valves or other valves, thereby raising the working opening of the well head to about two feet (0.6 m) to about six feet (1.8 m) above the surrounding ground surface. Thus, system 50 provides for vertical adjustment of a position of crate 54; this allows for variation in clearance above a wellbore 80 and accommodates various heights of working platform 62 above a ground surface on which the deployer 52 rests. In an exemplary embodiment, a hydraulically powered scoping cylinder 74 is used to vertically adjust the height of the crate/deployer assembly in a vertical configuration.

The scoping cylinder 74 moves the crate support frame 64 longitudinally along crate support rails 65. Rails 65 are spaced apart by connectors 164. In an exemplary embodiment, crate support frame 64 includes side members 160 that slide longitudinally along crate support rails 65. The side members are connected by spaced brackets 162. In an exemplary embodiment, one end of scoping cylinder 74 is connected to the crate support rails 65 and another end of the scoping cylinder is connected to crate support frame 64. Thus, when scoping cylinder 74 extends and retracts, crate support frame 64 slides along crate support rails 65. Accordingly, in the vertical configuration of FIGS. 9, 11, 12, 13A, 17 and 20, actuation of the scoping cylinder 74 moves crate attachment bracket 68 (and any attached crate 54) vertically. In the horizontal configuration of FIGS. 7 and 10, actuation of the scoping cylinder 74 moves crate attachment bracket 68 (and any attached crate 54) horizontally. A comparison of FIGS. 5 and 6 shows displacement of crate support frame 64 horizontally on crate support rails 65. A suitable cylinder 74 includes, for example, a double acting telescopic cylinder commercially available from Custom Hoists, Inc. of Hayesville, Ohio.

Referring to FIG. 17, once a final height of crate 54 has been established, a crew member can climb the integrated ladder 72 to access the working platform 62 of the deployer 52. The platform is typically about 25 feet (7.6 m) above the ground surface, and the worker handles just one rod 78 at a time. Once on the platform 62, the crew member secures him/herself to the deployer 52 using appropriate fall protection equipment that can be attached to railing 154, for example. The platform 62 is designed for the elevated worker to be able reach rods 78 that are elevated to him by the workover rig 146 and also to reach into the farthest points of the crate 54 to and from which he will be transferring the rods 78 in or out. In the system 50 as set up in FIGS. 17-20, the worker would be facing toward the workover rig 146, with the crate 54 to his/her left and with the drill lines 148 moving up and down to his/her right. The trolley 144 moves from left and right and carries a rod transfer bottle or lift cylinder 142 on jib crane 140.

Depending on the task at hand, the elevated crew member can transfer rods 78 into or out of the crate 54. Using the jib crane 140 and trolley 144, equipped with a rod transfer bottle or lift cylinder 142, rods 78 can be transferred from the workover rig 146 into the crate 54 or from the crate 54 to the workover rig 146 using mechanical means and minimal physical effort. A suitable lift cylinder 142 is commercially available from Dakota Fluid Power of Sioux Falls, S. Dak. The cylinder 142 is extended or retracted under the control of the elevated worker. The support 156 for the jib crane 140 extends above the platform 62. The support 156 and/or jib crane 140 can be rotated in the horizontal plane to position the jib crane 140 at a convenient location for the worker. The cylinder 142 is attached to the trolley 144, which travels the length of the horizontal section of the crane 140. The trolley 144 and cylinder 142 allow the crew member to maneuver the full weight of a rod 78 with ease between the rod crate 54 and the workover rig's lifting equipment, such as traveling block 150.

Figure 21:
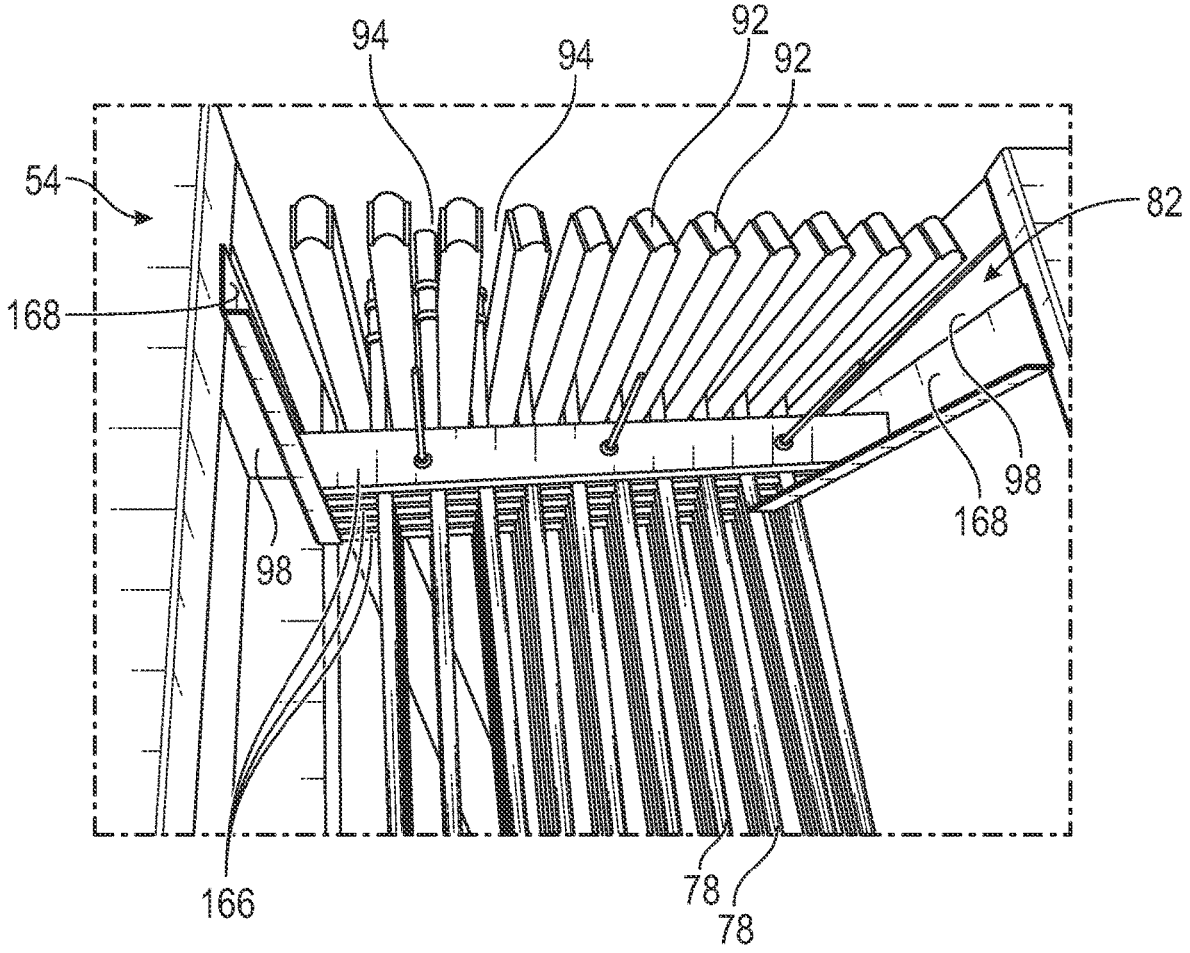
FIG. 21 is a partial perspective view of a crate from the underside of a rod support partially filled with rods and separated by cribbing.

In a process of tripping rods out of the wellbore, the elevated worker uses cylinder 142 to latch onto a top of rod 78 and remove it from traveling block 150. The cylinder 142 with the connected rod 78 is moved from the right side of crane 140 toward the left side thereof to a receiving slot pocket 94, 106 between the rod support fingers 92 and the rod guide fingers 104. The worker pushes the rod 78 into one of the slot pockets 94 to hang the rod 78 from the between aligned support fingers 92. Once a row is filled (wherein a row is perpendicular to a slot 94, 106; for example, a row may consist of one rod in each slot 94, 106 in contact with back frame member 96), an employee installs a cribbing bar 166 for securement and to provide rod separation. FIG. 21 is a partial perspective view of a crate 54 from the underside of a rod support 82, partially filled with rods 78. The rods 78 in slots 94, 106 are separated by cribbing bars 166, which are placed perpendicular to the fingers 92, 104. In an exemplary embodiment, cribbing guides 168 (not shown in all drawings) are attached to side frame members 98 of rod support 82 and each rod guide 84 to support cribbing bars 166. Cribbing bars 166 are installed to prevent adjacent rods 78 from touching each other. Cribbing bars 166 space the rods 78 apart, preventing them from touching and rubbing together while in transit; this step can reduce physical damage and material fatigue in the rods 78. In an exemplary embodiment, each cribbing guide 168 is configured as a right angle metal member.

Figure 22A:
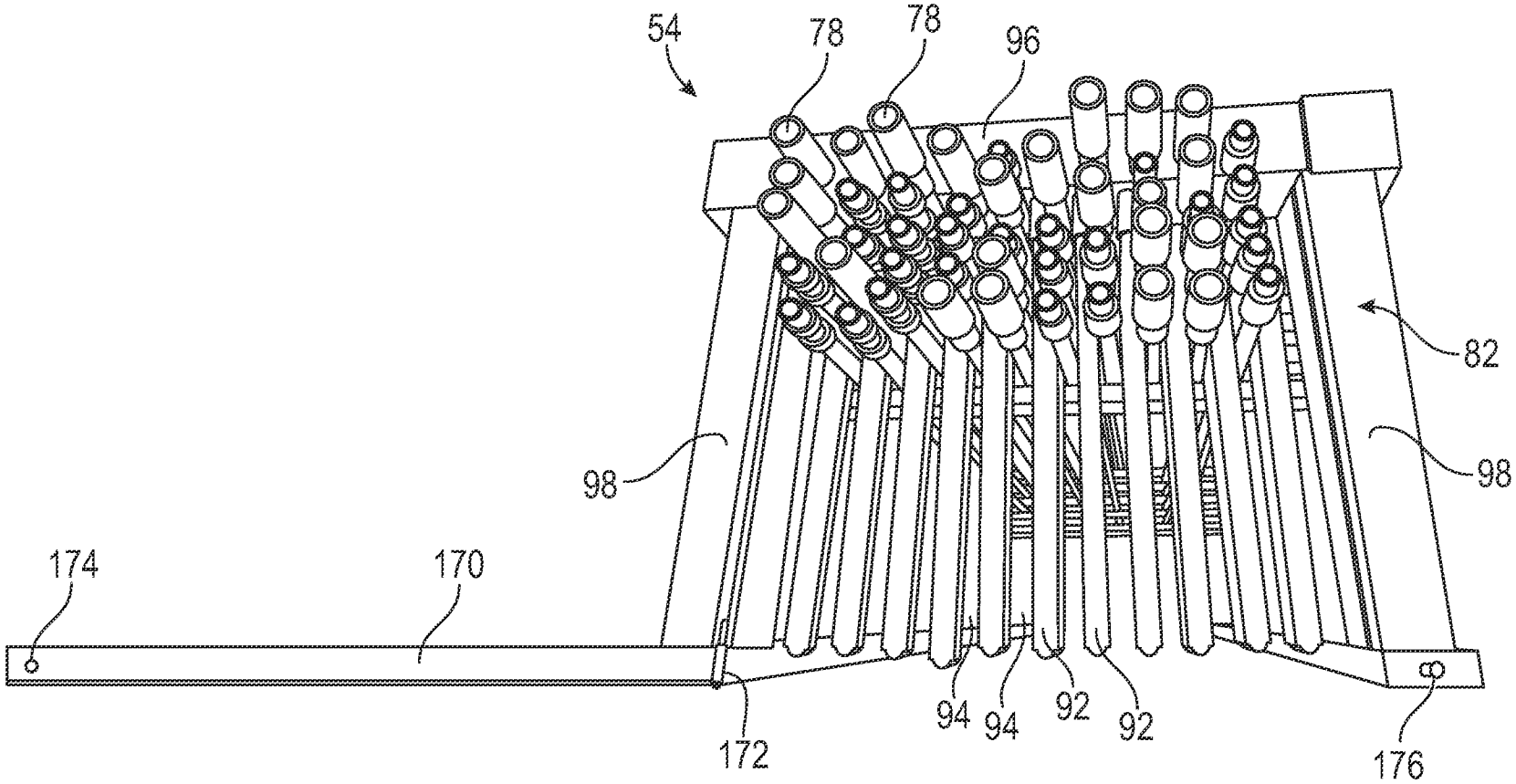
FIG. 22A is top perspective view of the crate of FIG. 21, with a lock bar on an open position.
Figure 22B:
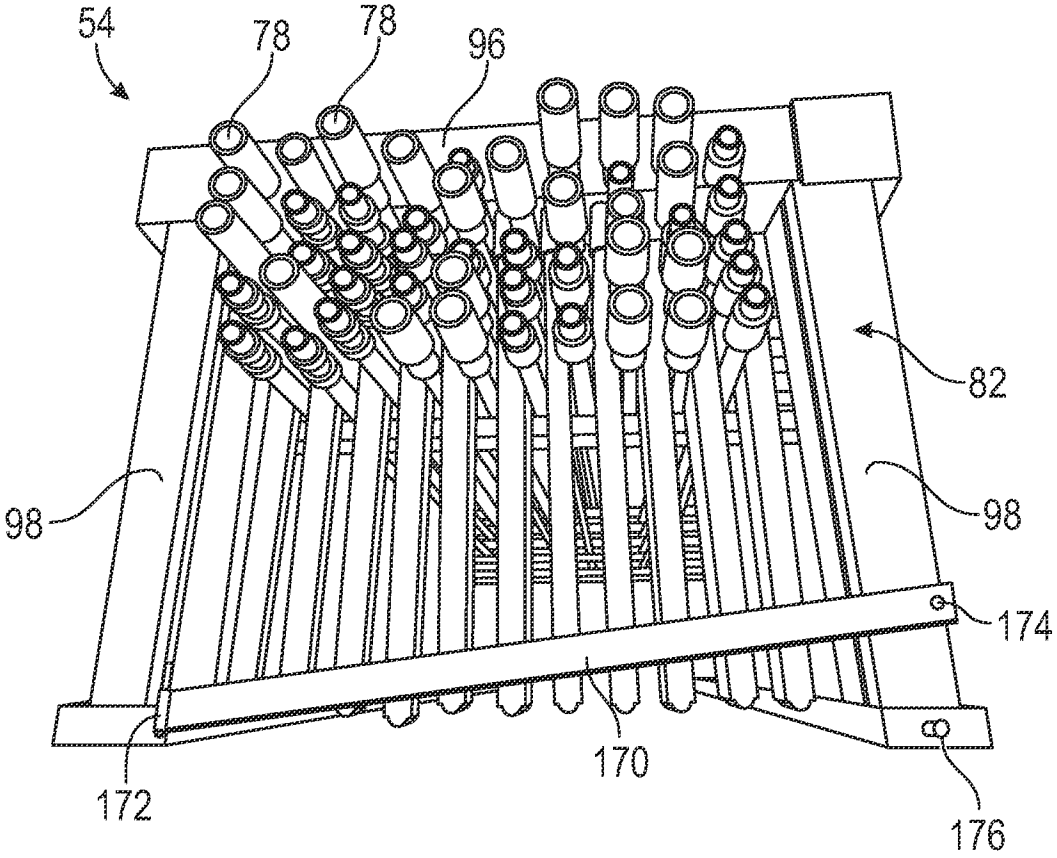
FIG. 22B is similar to FIG. 22A but shows the lock bar being pivoted to a closed position.

FIG. 22A is top perspective view of the crate of FIG. 21, with a hurricane bar or lock bar 170 on an open position. FIG. 22B is similar to FIG. 22A but shows the lock bar 170 being pivoted to a closed position. In an exemplary embodiment, lock bar 170 is attached to one of the side frame members 98 of rod support 82 and of the end rod guide 84 at pivot connection 172 (such as a hinge, for example). After a crate 54 is filled with rods 78 (or the operation otherwise completed), the elevated worker closes lock bar 170 and secures it to the opposite side frame member 98 by insertion of a fastener through aligned apertures 174, 176. Similarly, a ground worker attaches lock bar 170 across the open side of the crate 54 at the bottom end rod guide 84.

The crate 54 is moved relative to the workover rig 146 by retracting the scoping cylinder 74. The mast lock 120 is then disengaged. Under control of a crew member, hydraulic cylinders 70 are actuated to move the deployer 52 and the connected crate 54 back into the horizontal position. In one method, once laid back, the crate/deployer securement pins 66 are disengaged from the crate pin receivers 90 by unlocking crate locks 108. The full crate 54 can then be removed using a loader 138. An empty crate 54 can then be attached to deployer 52 and locked with crate lock 108, using pins 66 in the aligned crate pin receivers 90 and pin holes 110 in crate attachment bracket 68 of deployer 52. This process is then repeated until all the rods of a rod string are removed from the wellbore 80.

Due to space requirements, a position of the laid down crate on the deployer may be adjusted horizontally to allow the loader 138 to access the stake or fork pockets 136. The deployer's hydraulic scoping cylinder 74 can adjust the crate's position horizontally to optimally position the fork pockets 136 and further create space between the end of the crate 54 and the workover rig 146. As shown in FIG. 6, in the horizontal position of crate 54, rod support 82 and rod guides 84 are oriented so that the rod compartment slots 94, 106 and fingers 92, 104 of support 82 and guides 84 are oriented horizontally. Thus, adjacent rods in the compartments lay side-by-side.

Using the described system and methods, tasks conventionally achieved with a four-member rig crew can be completed with three members. One member operates the rig 146, one member operates the equipment used to screw or unscrew the rods 78 at the wellbore 80, and one completes the tasks on the elevated platform 62. Additionally, cribbing bars 166 can be installed by the operator on platform 62 as he or she fills the crate from the back to the front (the front being the open side of the rod slots).

It is anticipated that in one method, oil field companies would utilize the crate 54 for new rods, beginning the process at the manufacturer or distributor. New rods 78 would be packaged into the crate 54, by which they would be delivered to a preparation ("prepping") location. Instead of utilizing the workover rig crew, a more economical and efficient process could be used to prepare the rods using a third party with more cost-effective labor while permitting the rig crew to complete other essential tasks simultaneously. The crate 54 allows the rod prepping procedures to be completed while secured in the crate. The prepped rods 78 can then be delivered to the final worksite without taking time and resources from the workover crew members.

The described systems and methods realize a reduction in physical labor, in potential damage to the rods, and in time associated with the conventional methods of tripping, prepping, and transporting rods. For example, the length of time used to handle each rod individually when moving the rods around a wellbore location is reduced to a few minutes versus hours. Finally, substantial cost savings to the purchaser of the rods is anticipated with the ability to prep the rods offsite and preserve their integrity in use.

Exemplary, non-limiting systems and methods are described. In one embodiment, a system 50 comprises a crate 54 and a deployer 52. The crate 54 is configured to contain a plurality of elongated rods 78. The crate 54 has a length, width and height. The deployer 52 comprises a bed frame upper surface 60, a crate support frame 64, a tilt mechanism 70, and a scope mechanism 74. The crate support frame 64 comprises a crate attachment bracket 68 configured for removable attachment of the crate 54, wherein the crate support frame 64 has a longitudinal extent aligned with the length of an attached crate 54. The tilt mechanism 70 is configured to move the crate support frame 64 between a horizontal position (shown in FIGS. 7, 8 and 10) parallel to the bed frame upper surface 60 and a vertical position (shown in FIGS. 9, 11, 12, 17 and 20) normal to the bed frame upper surface 60. The scope mechanism 74 is configured to move the crate support frame 64 linearly along crate support rails 65.

In an exemplary embodiment, the tilt mechanism 70 comprises one or more hydraulic cylinders. In an exemplary embodiment, the scope mechanism 74 comprises one or more hydraulic cylinders. In an exemplary embodiment, the deployer 52 comprises a platform 62 connected to the crate support frame 64. In an exemplary embodiment, the deployer 52 comprises a ladder 72 connected to the crate support frame 64. In an exemplary embodiment, the deployer 52 comprises a jib crane 140 connected to the crate support frame 64. In an exemplary embodiment, the deployer 52 comprises a trolley 144 connected to the crane 140. In an exemplary embodiment, the deployer 52 comprises a plurality of ground engaging wheels 76.

In an exemplary embodiment, the crate 54 comprises a first plurality of rod support fingers 92 of rod support 82 disposed at one end of the crate 54 and a second plurality of rod guide fingers 104 of rod guide 84 disposed at an intermediate location along the length of the crate 54. The first and second plurality of fingers 92, 104 are aligned with each other to provide rod receiving slots 94, 106 therebetween. In an exemplary embodiment, the crate 54 comprises a lift base 134 comprising a plurality of channels 136.

In an exemplary embodiment, a method of deploying a plurality of rods 78 to a selected location comprises attaching a first crate 54 containing the plurality of rods 78 to a deployer 52, transporting the deployer 52 to the selected location, actuating a tilt mechanism 70 to raise the first crate 54 from the horizontal position to the vertical position, and actuating a scope mechanism 74 to move the first crate 54 vertically to a desired height above a ground surface. In an exemplary embodiment, the method comprises locking the crate support rails 65 in the vertical position using pin 66 to connect the crate support rails 65 and the bed frame 60.

In an exemplary embodiment, the method comprises actuating the scope mechanism 74 while the crate support frame 64 is disposed in the horizontal position, to move the first crate 54 horizontally above the ground surface.

In an exemplary embodiment, the method comprises detaching the first crate 54 from the deployer 52. In an exemplary embodiment, the method comprises removing the first crate 54 from the deployer 52. In an exemplary embodiment, the method comprises inserting a tine of a loader 138 into a channel 136 in a base 134 of the first crate 54. In an exemplary embodiment, the method comprises attaching a second crate 54 to the crate support frame 64.

In an exemplary method, when both the first and second crates 54 are removed from the deployer 52, the method comprises stacking the first and second crates 54. In an exemplary method, transporting the deployer 52 comprises towing the deployer with a truck 56. In an exemplary method, the selected location is proximate a wellbore 80.

Although the subject of this disclosure has been described with reference to an exemplary embodiment, workers skilled in the art will recognize that changes may be made in form and detail without departing from the scope of the disclosure. For example, while hydraulic actuation is described, other actuation devices and methods such as electrical and other mechanical apparatuses can be employed alternatively or additionally.

The invention claimed is:

1. A system comprising:
- a crate:
  - configured to contain a plurality of elongated rods;
  - having a length, a width and a height; and
  - comprising a plurality of receivers spaced along the length of the crate; and
- a deployer comprising:
  - a bed frame upper surface;
  - a crate support frame:
    - configured for removable attachment of the crate;
    - having a longitudinal extent; and
    - comprising a plurality of locks configured for respective engagement with the plurality of receivers, the plurality of locks being spaced along the longitudinal extent of the crate support frame;
  - a tilt mechanism configured to move the crate support frame between a horizontal position parallel to the bed frame upper surface and a vertical position normal to the bed frame upper surface; and
  - a scope mechanism configured to move the crate support frame linearly along its longitudinal extent.

2. The system of claim 1 wherein the tilt mechanism comprises a hydraulic cylinder.

3. The system of claim 1 wherein the scope mechanism comprises a hydraulic cylinder.

4. The system of claim 1 wherein the deployer comprises a platform connected to the crate support frame.

5. The system of claim 1 wherein the deployer comprises a ladder connected to the crate support frame.

6. The system of claim 1 wherein the deployer comprises a jib crane connected to the crate support frame.

7. The system of claim 6 wherein the deployer comprises a trolley connected to the jib crane.

8. The system of claim 1 wherein the deployer comprises a plurality of individually actuable outriggers.

9. The system of claim 1 wherein the crate comprises:
- a first plurality of rod support fingers disposed at one end of the crate; and
- a second plurality of rod guide forgers disposed at an intermediate location along the length of the crate;
- wherein the first and second plurality of rod fingers are aligned with each other.

10. The system of claim 1 wherein the crate comprises a lift base comprising a plurality of channels.

11. The system of claim 1, wherein at least one of the plurality of locks comprises an extendable cylinder.

12. A method of deploying a plurality of rods to a selected location, the method comprising:
- attaching a first crate containing the plurality of rods to a deployer, wherein the first crate is disposed in a horizontal position, and wherein the deployer comprises:
  - a bed frame upper surface;
  - a crate support frame having a longitudinal extent and comprising a plurality of locks spaced along the longitudinal extent;
  - a tilt mechanism configured to move the crate support frame between the horizontal position parallel to the bed frame upper surface and a vertical position normal to the bed frame upper surface; and
  - a scope mechanism configured to move the crate support frame linearly along its longitudinal extent;
- wherein the first crate comprises a plurality of receivers spaced along a length of the first crate, and wherein the attaching comprises engaging the plurality of locks with respective ones of the plurality of receivers;

transporting the deployer to the selected location;

actuating the tilt mechanism to raise the first crate from the horizontal position to the vertical position; and actuating the scope mechanism to move the first crate vertically to a desired height above a ground surface.

13. The method of claim 12 comprising actuating the scope mechanism while the crate support frame is disposed in the horizontal position, to move the first crate horizontally above the ground surface.

14. The method of claim 12 wherein the deployer comprises a bed frame end and a crate support rail, the method comprising locking the crate support rail to the bed frame end in a vertical position.

15. The method of claim 12 comprising detaching the first crate from the deployer.

16. The method of claim 15 comprising attaching a second crate to the crate support frame.

17. The method of claim 15 comprising inserting a tine of a loader into a channel in a base of the first crate.

18. The method of claim 15 comprising stacking the first crate onto a second crate.

19. The method of claim 12 wherein transporting the deployer comprises towing the deployer with a truck.

20. The method of claim 12 wherein the selected location is proximate a wellbore.

* * * * *